US008904947B2

(12) United States Patent
Nishimura et al.

(10) Patent No.: US 8,904,947 B2
(45) Date of Patent: Dec. 9, 2014

(54) SEWING MACHINE

(71) Applicants: Yoshio Nishimura, Nagoya (JP); Satoru Ichiyanagi, Nagoya (JP); Yutaka Nomura, Anjo (JP); Yoshinori Nakamura, Toyohashi (JP); Yuki Ihira, Kakamigahara (JP); Daisuke Abe, Nagoya (JP); Akie Shimizu, Nagoya (JP)

(72) Inventors: Yoshio Nishimura, Nagoya (JP); Satoru Ichiyanagi, Nagoya (JP); Yutaka Nomura, Anjo (JP); Yoshinori Nakamura, Toyohashi (JP); Yuki Ihira, Kakamigahara (JP); Daisuke Abe, Nagoya (JP); Akie Shimizu, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 84 days.

(21) Appl. No.: 13/788,903

(22) Filed: Mar. 7, 2013

(65) Prior Publication Data

US 2013/0233218 A1 Sep. 12, 2013

(30) Foreign Application Priority Data

Mar. 12, 2012 (JP) ..... 2012-055110

(51) Int. Cl.

| | |
|---|---|
| ***D05B 21/00*** | (2006.01) |
| ***D05B 19/12*** | (2006.01) |
| *D05C 5/02* | (2006.01) |

(52) U.S. Cl.

CPC ..... *D05B 19/12* (2013.01)
USPC ..... 112/470.06; 700/138

(58) Field of Classification Search

CPC ..... D05B 19/02–19/10; D05B 19/16; D05B 11/00; D05B 27/02; D05C 9/04; D05C 9/22
USPC ..... 112/102.5, 103, 119, 315, 470.01, 112/470.04, 470.06; 700/138
See application file for complete search history.

(56) References Cited

U.S. PATENT DOCUMENTS

| | | | |
|---|---|---|---|
| 3,966,331 | A | 6/1976 | Inuiya |
| 4,998,489 | A | 3/1991 | Hisatake et al. |
| 5,072,680 | A | 12/1991 | Nakashima |
| 5,195,451 | A | 3/1993 | Nakashima |

(Continued)

FOREIGN PATENT DOCUMENTS

| | | |
|---|---|---|
| JP | S64-040386 | 3/1989 |
| JP | A-3-234283 | 10/1991 |

(Continued)

OTHER PUBLICATIONS

U.S. Appl. No. 13/912,712, filed Jun. 7, 2013 in the name of Yoko Yamanashi.

(Continued)

*Primary Examiner* — Ismael Izaguirre
(74) *Attorney, Agent, or Firm* — Oliff PLC

(57) ABSTRACT

A sewing machine includes a sewing portion, a detector, a processor, and a memory. The sewing portion includes a needle bar and a transport portion. The needle bar is configured to have a sewing needle on a lower end. The transport portion is configured to move a work cloth. The detector is configured to detect ultrasonic waves. The memory stores computer-readable instructions that instruct the processor to perform specifying a position of a transmission source of the ultrasonic waves based on the ultrasonic waves that are detected by the detector, specifying sewing information based on the specified position of the transmission source, the sewing information being information that pertains to sewing, and controlling the sewing portion based on the specified sewing information.

9 Claims, 17 Drawing Sheets

(56) References Cited

U.S. PATENT DOCUMENTS

| | | | | |
|---|---|---|---|---|
| 6,000,350 | A | 12/1999 | Koike et al. | |
| 6,883,446 | B2 * | 4/2005 | Koerner | 112/272 |
| 7,079,917 | B2 | 7/2006 | Taguchi et al. | |
| 7,373,891 | B2 | 5/2008 | Koerner | |
| 8,061,286 | B2 * | 11/2011 | Hirata et al. | 112/470.01 |
| 8,074,590 | B2 * | 12/2011 | Bentley | 112/470.04 |
| 8,528,491 | B2 | 9/2013 | Bentley | |
| 8,567,329 | B2 * | 10/2013 | Kishi | 112/470.04 |
| 8,763,542 | B2 * | 7/2014 | Abe et al. | 112/102.5 |
| 2004/0182295 | A1 | 9/2004 | Pfeifer | |
| 2009/0188413 | A1 | 7/2009 | Hirata et al. | |
| 2011/0226170 | A1 | 9/2011 | Tokura | |
| 2012/0111249 | A1 | 5/2012 | Sekine | |
| 2012/0210925 | A1 | 8/2012 | Koga et al. | |
| 2013/0233217 | A1 | 9/2013 | Shimizu et al. | |
| 2013/0233219 | A1 * | 9/2013 | Nakamura et al. | 112/470.06 |
| 2013/0233220 | A1 * | 9/2013 | Nomura et al. | 112/470.06 |
| 2013/0233221 | A1 * | 9/2013 | Abe et al. | 112/470.06 |
| 2013/0233222 | A1 * | 9/2013 | Nishimura et al. | 112/470.06 |
| 2014/0000498 | A1 * | 1/2014 | Yamanashi et al. | 112/102.5 |

FOREIGN PATENT DOCUMENTS

| | | |
|---|---|---|
| JP | A-5-15667 | 1/1993 |
| JP | A-06-000264 | 1/1994 |
| JP | A-2007-128120 | 5/2007 |
| JP | A-2009-172123 | 8/2009 |
| JP | A-2011-194043 | 10/2011 |

OTHER PUBLICATIONS

Mar. 4, 2014 Office Action issued in U.S. Appl. No. 13/788,979.
Feb. 4, 2014 Office Action issued in Japanese Patent Application No. 2012-055103 (with English Translation).
U.S. Appl. No. 13/788,928, filed Mar. 7, 2013 in the name of Yoshinori Nakamura et al.
U.S. Appl. No. 13/789,046, filed Mar. 7, 2013 in the name of Daisuke Abe et al.
U.S. Appl. No. 13/789,061, filed Mar. 7, 2013 in the name of Yoshio Nishimura et al.
U.S. Appl. No. 13/788,979, filed Mar. 7, 2013 in the name of Yutaka Nomura et al.
U.S. Appl. No. 13/788,893, filed Mar. 7, 2013 in the name of Akie Shimizu et al.

* cited by examiner

SEWING MACHINE

CROSS-REFERENCE TO RELATED APPLICATION

This application claims priority to Japanese Patent Application No. 2012-055110, filed Mar. 12, 2012, the content of which is hereby incorporated herein by reference in its entirety.

BACKGROUND

The present disclosure relates to a sewing machine that performs sewing based on sewing information that has been received from a user.

A sewing machine performs sewing on a work cloth by operating a needle bar, a feed dog, and the like based on various types of information (hereinafter referred to as the sewing information) that pertains to the sewing. The sewing information may include a swing width for a stitch, the length of a stitch, and a base line position that indicates a needle drop position for a sewing needle that is mounted on a needle bar, as well as the size, angle, and the like for a decorative stitch or an embroidery pattern. The sewing information is input by the user. For example, a sewing machine is known that is provided with a liquid crystal display and a transparent touch panel and performs sewing based on the sewing information that is received from the user through the touch panel. The sewing machine displays a menu screen on the liquid crystal display. Through the touch panel, the sewing machine receives the sewing information that is selected by the user.

SUMMARY

However, cases occur in which the desired stitch or pattern that the user, through the screen that is displayed on the liquid crystal display, specifies as the stitch or pattern that will be sewn is different from the stitch or pattern that is actually sewn by the sewing machine. Therefore, cases occur in which the stitch or pattern that has been sewn by the sewing machine, based on the sewing information that was selected through the touch panel, is different from the stitch or pattern that the user desired. Cases occur in which the known sewing machine cannot perform the sewing on the work cloth in accordance with the user's intentions, because the sewing information is set on the touch panel.

Various embodiments of the broad principles derived herein provide a sewing machine that makes it possible for the user to set directly on the work cloth the sewing information for performing the sewing on the work cloth.

Embodiments provide a sewing machine that includes a sewing portion, a detector, a processor, and a memory. The sewing portion includes a needle bar and a transport portion. The needle bar is configured to have a sewing needle on a lower end. The transport portion is configured to move a work cloth. The detector is configured to detect ultrasonic waves. The memory stores computer-readable instructions that instruct the processor to perform specifying a position of a transmission source of the ultrasonic waves based on the ultrasonic waves that are detected by the detector, specifying sewing information based on the specified position of the transmission source, the sewing information being information that pertains to sewing, and controlling the sewing portion based on the specified sewing information.

BRIEF DESCRIPTION OF THE DRAWINGS

Embodiments will be described below in detail with reference to the accompanying drawings in which.

DETAILED DESCRIPTION

Figure 1:
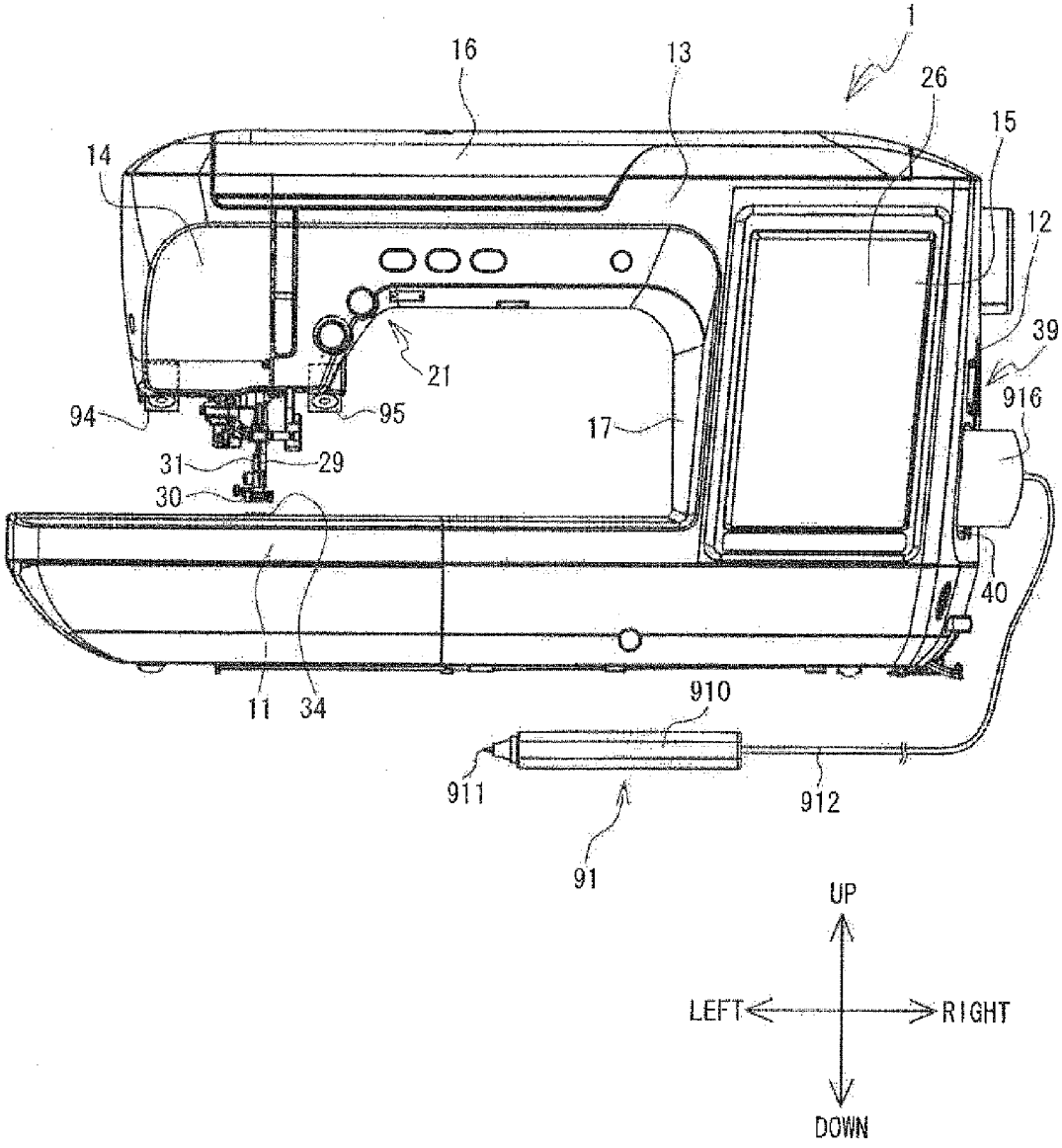
FIG. 1 is a front view of a sewing machine.

Hereinafter, an embodiment of the present disclosure will be explained with reference to the drawings. The configuration of a sewing machine 1 will be explained with reference to FIG. 1. The top side, the bottom side, the left side, and the right side in FIG. 1 respectively define the top side, the bottom side, the left side, and the right side of the sewing machine 1. A side on which operation switches 21 are provided is defined as the front side of the sewing machine 1.

The sewing machine 1 includes a bed 11, a pillar 12, an arm 13, and a head 14. The bed 11 is a base portion of the sewing machine 1, and the bed 11 extends in the left-right direction. The pillar 12 extends upward from the right end of the bed 11. The arm 13 extends to the left from the upper end of the pillar 12 such that the arm 13 is opposite of the bed 11. The head 14 is located on the left end of the arm 13. A needle plate 34 is disposed on the top face of the bed 11. A feed dog (not shown in the drawings), a feed mechanism (not shown in the drawings), a shuttle mechanism (not shown in the drawings), and a feed adjustment motor 83 (refer to FIG. 5) are provided underneath the needle plate 34 (that is, inside the bed 11). The feed dog may be driven by the feed mechanism and move a work cloth 100 (refer to FIG. 8) in a front-rear direction by a specified feed amount. The feed amount for the feed dog may be adjusted by the feed adjustment motor 83.

A needle bar 29 and a presser bar 31 extend downward from the lower end of the head 14. A sewing needle (not shown in the drawings) can be attached to the lower end of the needle bar 29. A presser foot 30 can be attached to the lower end of the presser bar 31. The presser foot 30 may press on the work cloth 100. A needle bar mechanism (not shown in the drawings), a swinging mechanism (not shown in the drawings), a swinging motor 80 (refer to FIG. 5), and the like are provided in the head 14. The needle bar mechanism is configured to move the needle bar 29 up and down. A sewing machine motor 79 (refer to FIG. 5) may drive the needle bar mechanism. The swinging mechanism is configured to swing the needle bar 29 to the left and to the right. The swinging mechanism may be driven by the swinging motor 80.

Receivers 94, 95 are provided on the rear portion of the lower end of the head 14. The receiver 94 and the receiver 95 have identical structures. The receiver 94 is provided on the rear part of the bottom face of the head 14 at the lower left edge of the head 14. The receiver 95 is provided on the rear part of the bottom face of the head 14 at the lower right edge of the head 14. The receivers 94, 95 are separated from one another by the length of the head 14 in the left-right direction. The receivers 94, 95 are configured to detect ultrasonic waves. The receivers 94, 95 will be described in detail later.

A cover 16 that can be opened and closed is provided in the upper portion of the arm 13. A spool (not shown in the drawings) may be accommodated under the cover 16, that is, approximately in the central portion inside the arm 13. An upper thread (not shown in the drawings) that is wound around the spool may be supplied from the spool to the sewing needle that is attached to the needle bar 29, by way of a thread guard portion (not shown in the drawings) that is provided in the head 14. The operation switches 21, which include a start-and-stop switch, are provided in the lower portion of the front face of the arm 13.

A liquid crystal display (hereinafter referred to as the LCD) 15 is provided on the front face of the pillar 12. A screen that includes various types of items, such as commands, illustrations, setting values, messages, and the like, may be displayed on the LCD 15. A touch panel 26 is provided on the front face of the LCD 15. By using a finger or a special touch pen to touch a location on the touch panel 26 that corresponds to an item that is displayed on the LCD 15, a user can select a pattern to be sewn or a command to be executed. Hereinafter, an operation that the user performs by using the touch panel 26 is referred to as a panel operation.

Connectors 39, 40 are provided on the right side face of the pillar 12. An external storage device (not shown in the drawings) such as a memory card or the like can be connected to the connector 39. The sewing machine 1 may acquire embroidery pattern data and various types of programs from the external storage device that is connected to the connector 39. A connector 916 is configured to be connected to the connector 40. The connector 916 is configured to be connected to a cable 912 that extends from an ultrasound pen 91 (described later). The sewing machine 1 may supply electric power to the ultrasound pen 91 through the connector 40, the connector 916, and the cable 912, and also acquire electrical signals that are output from the ultrasound pen 91.

The ultrasound pen 91 will be explained. The ultrasound pen 91 includes a pen body 910 and a pen tip 911. The shape of the pen body 910 is a bar shape. The pen tip 911 is provided on one end of the pen body 910. The tip of the pen tip 911 is pointed. The pen tip 911 is able to move between a projecting position and a retracted position. The projecting position is a position in which the pen tip 911 projects slightly to the outside of the pen body 910. In a state in which an external force is not acting on the pen tip 911, the pen tip 911 is positioned in the projecting position. When a force acts on the pen tip 911 that is in the projecting position in the direction toward the pen body 910, the pen tip 911 moves into the pen body 910, and the pen tip 911 shifts to the retracted position. When the force that is acting on the pen tip 911 ceases, the pen tip 911 returns to the projecting position.

A switch 913 (refer to FIG. 5), a signal output circuit 914 (refer to FIG. 5), and an ultrasound transmitter 915 (refer to FIG. 5) are provided inside the pen body 910. The switch 913 may switch between an ON state and an OFF state in accordance with the position of the pen tip 911. The switch 913 may switch the output states of the signal output circuit 914 and the ultrasound transmitter 915.

When the pen tip 911 is positioned in the projecting position, the switch 913 is in the OFF state. In a case where the switch 913 is in the OFF state, the signal output circuit 914 does not output an electrical signal, and the ultrasound transmitter 915 does not transmit ultrasonic waves. On the other hand, the pen tip 911 is shifted to the retracted position by the user's pressing of the pen tip 911 against the work cloth 100, for example. The switch 913 is switched to the ON state by the positioning of the pen tip 911 in the retracted position. When the switch 913 is in the ON state, the signal output circuit 914 outputs an electrical signal to the sewing machine 1 through the cable 912, and the ultrasound transmitter 915 transmits ultrasonic waves.

Note that the sewing machine 1 may use the receivers 94, 95 to detect (receive) the ultrasonic waves that are transmitted from the ultrasound pen 91, although this will be described in detail later. Based on the detected ultrasonic waves, the sewing machine 1 may specify the position of the transmission source of the ultrasonic waves, that is, the ultrasound transmitter 915 that is provided in the ultrasound pen 91. The sewing machine 1 may perform sewing based on the specified position.

The receiver 94 will be explained with reference to FIGS. 2 to 4. The receiver 95 has an identical structure to that of the receiver 94. Therefore, an explanation of the receiver 95 will be omitted. The lower left side, the upper right side, the upper left side, the lower right side, the top side, and the bottom side in FIG. 2 respectively define the front side, the rear side, the left side, the right side, the top side, and the bottom side of the receiver 94.

Figure 2:
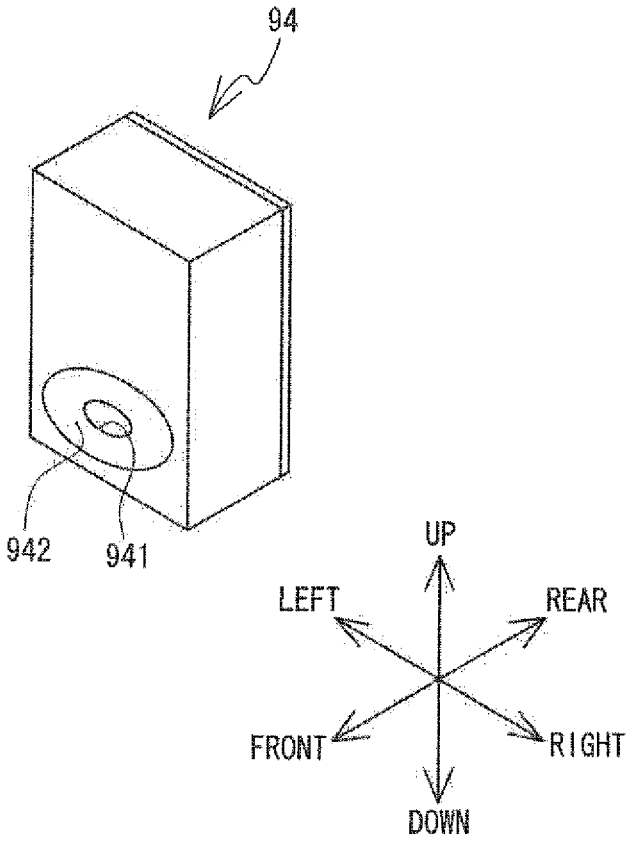
FIG. 2 is a perspective view of a receiver.
Figure 3:
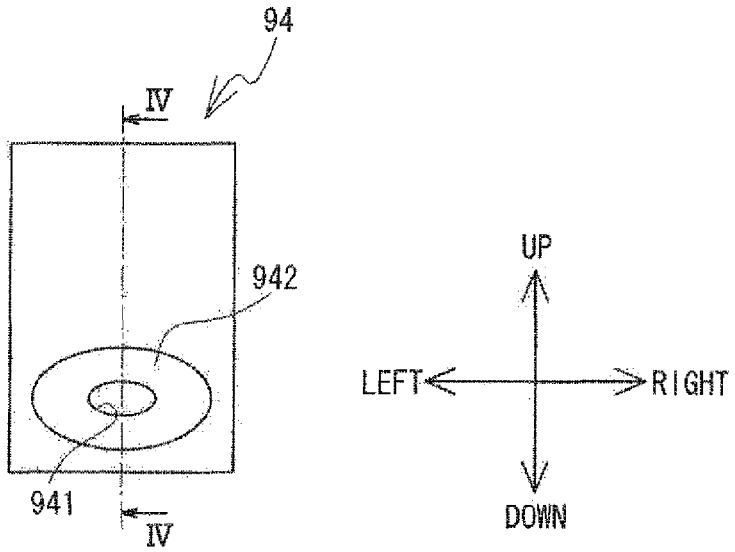
FIG. 3 is a front view of the receiver.
Figure 4:
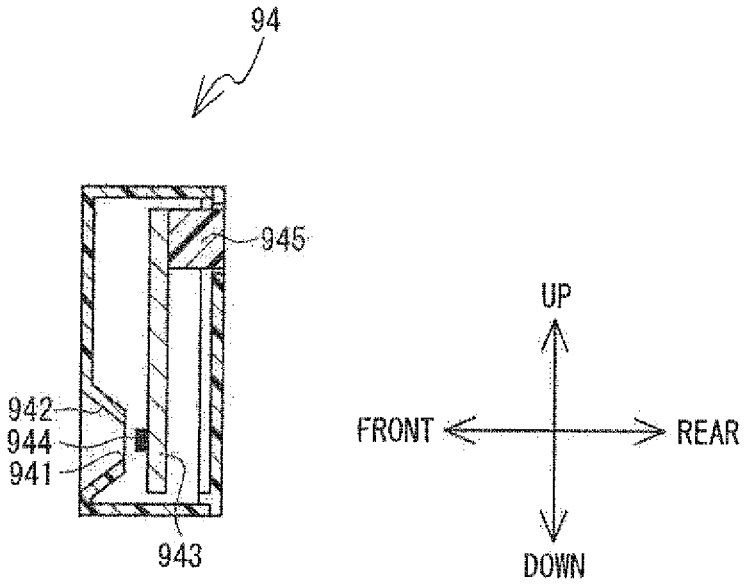
FIG. 4 is a section view of the receiver in the direction of a line IV-IV that is shown in FIG. 3.

As shown in FIGS. 2 and 3, the shape of the receiver 94 is a rectangular parallelepiped shape that is slightly longer in the up-down direction. The receiver 94 is provided with an opening 941 in the center of the lower portion of a front face of the receiver 94. The shape of the opening 941 is an ellipse whose long axis extends in the left-right direction. A surrounding portion 942 that is a portion that surrounds the opening 941 is a tapered surface (an inclined surface) that becomes larger toward the front side. As shown in FIG. 4, an electrical circuit board 943 and a microphone 944 are provided in the interior of the receiver 94. The microphone 944 is positioned on the inner side of the opening 941. A connector 945 is mounted on the rear face of the upper end of the electrical circuit board 943. The connector 945 is configured to be connected to a connector (not shown in the drawings) that is provided in the sewing machine 1.

Figure 5:
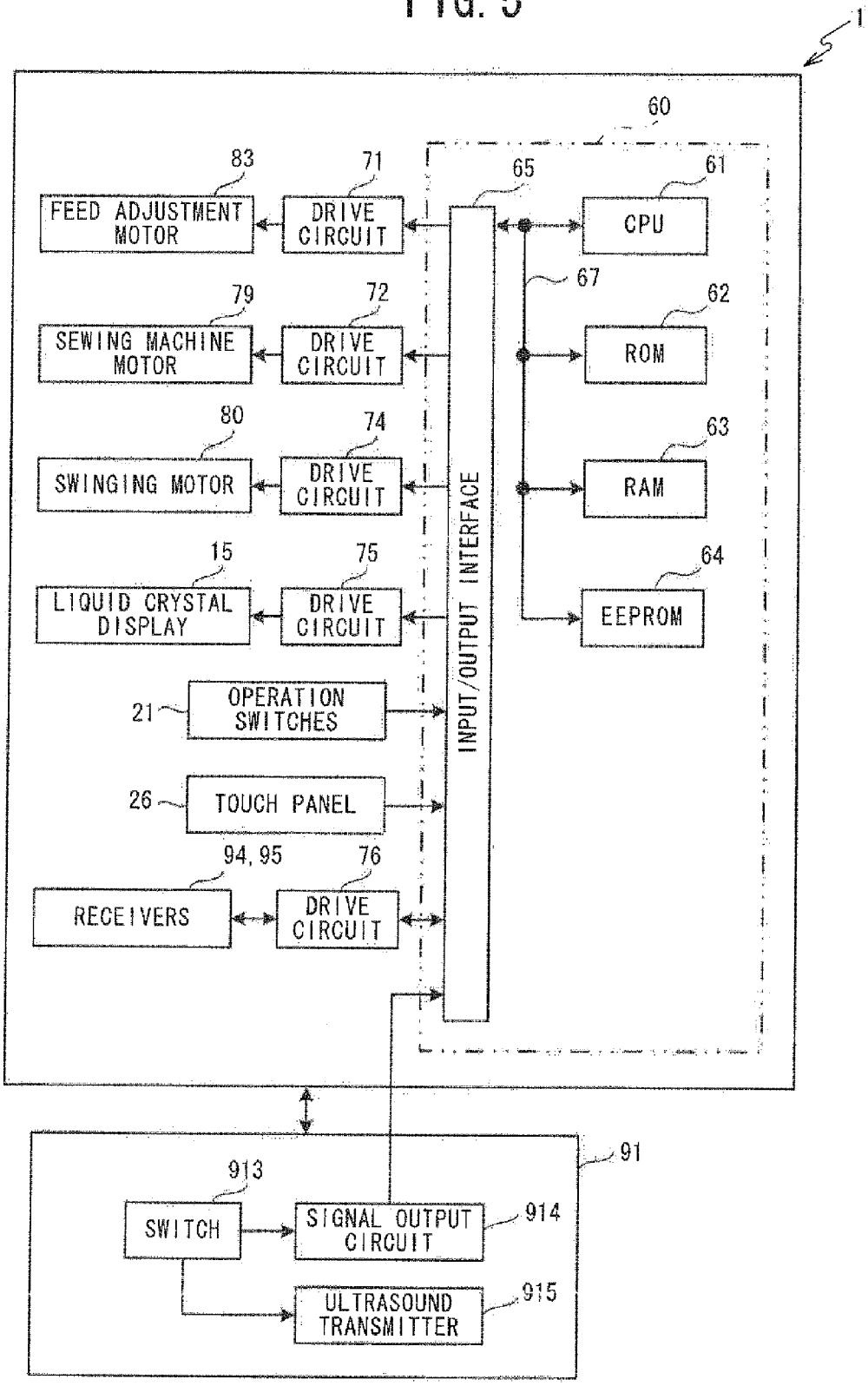
FIG. 5 is a block diagram that shows an electrical configuration of the sewing machine.

The electrical configuration of the sewing machine 1 will be explained with reference to FIG. 5. A control portion 60 of the sewing machine 1 includes a CPU 61, a ROM 62, a RAM 63, an EEPROM 64, and an input/output interface 65. The CPU 61, the ROM 62, the RAM 63, the EEPROM 64, and the input/output interface 65 are connected to one another through a bus 67. Programs that the CPU 61 may use to perform processing, data for a plurality of types sewing patterns that the sewing machine 1 may use to perform sewing, as well as data and the like, are stored in the ROM 62. Data that indicate settings of the sewing machine 1 and the like are stored in the EEPROM 64.

The operation switches 21, the touch panel 26, and drive circuits 71, 72, 74, 75, 76 are electrically connected to the input/output interface 65. The drive circuits 71, 72, 74, 75, 76 may respectively drive the feed adjustment motor 83, the sewing machine motor 79, the swinging motor 80, the LCD 15, and the receivers 94, 95. An amplifier circuit that may amplify and transmit to the CPU 61 the ultrasonic wave signals that are detected by the receivers 94, 95 is included in the drive circuit 76.

The electrical configuration of the ultrasound pen 91 will be explained. The ultrasound pen 91 includes the switch 913, the signal output circuit 914, and the ultrasound transmitter 915. The switch 913 is configured to be connected to the signal output circuit 914 and the ultrasound transmitter 915. The signal output circuit 914 is configured to be connected to the input/output interface 65. The signal output circuit 914 may output electrical signals to the CPU 61 through the input/output interface 65.

Figure 6:
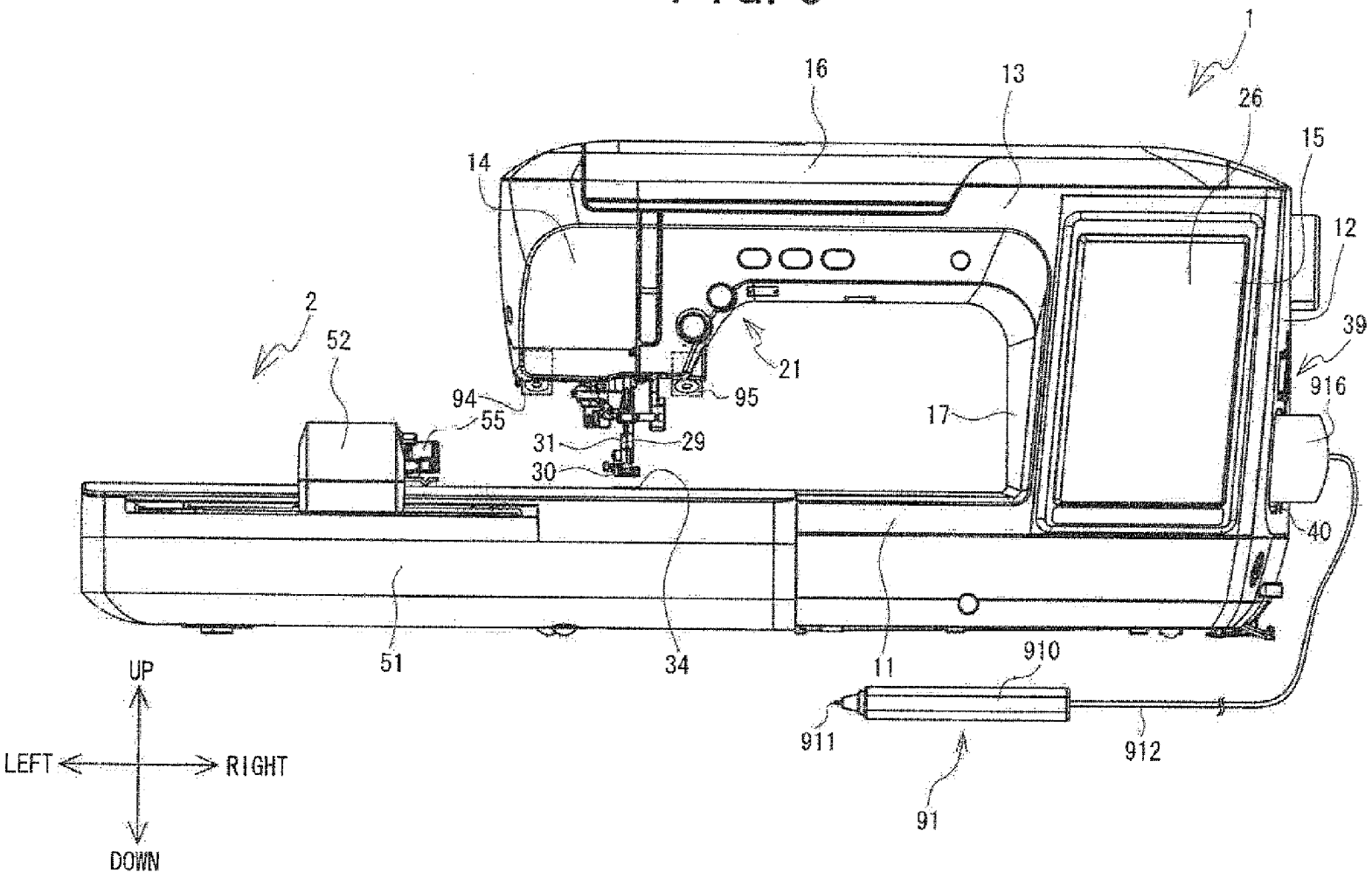
FIG. 6 is a front view of the sewing machine with an embroidery device mounted on it.
Figure 7:
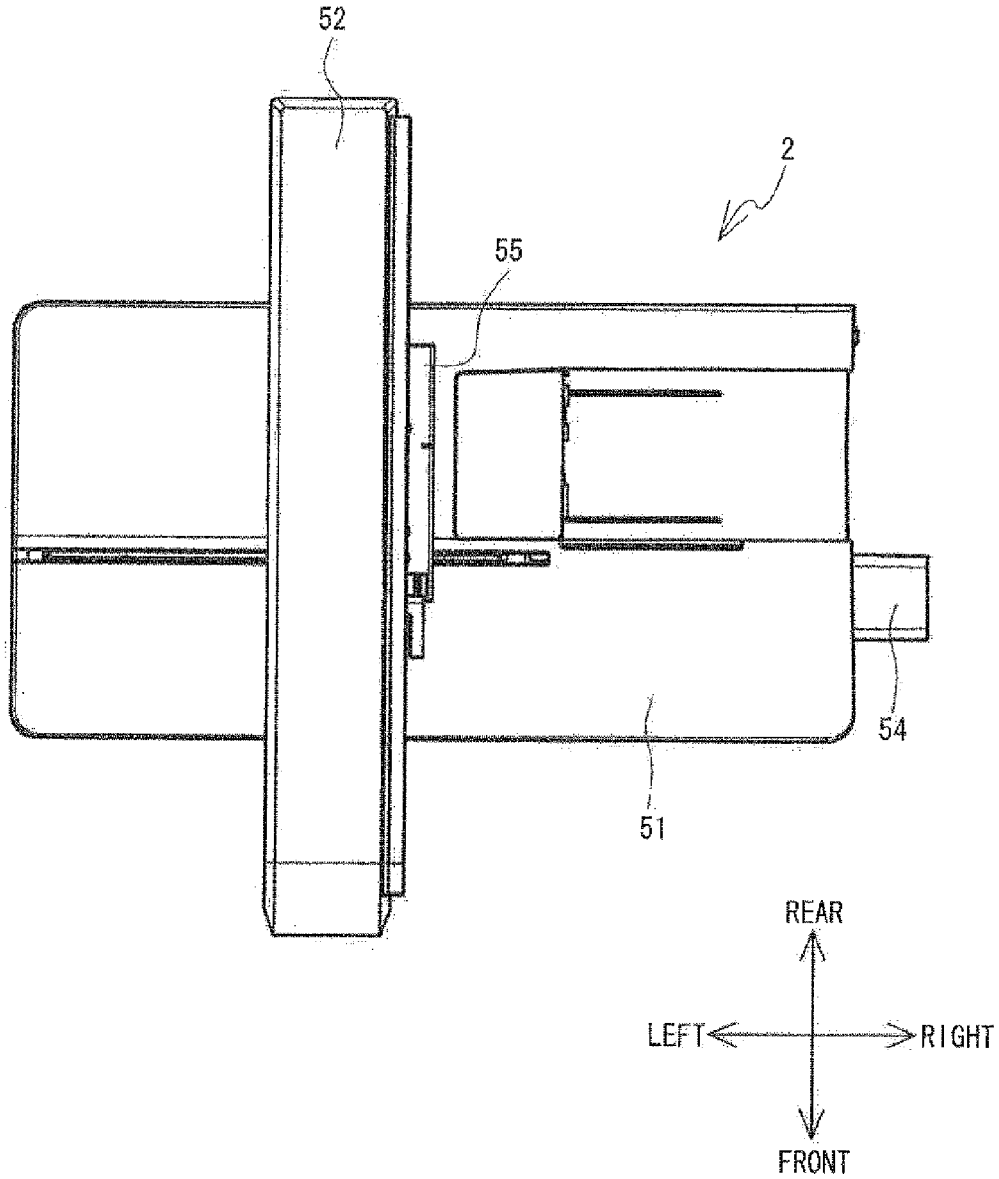
FIG. 7 is a plan view of the embroidery device.

FIG. 6 shows the sewing machine 1 in a state in which an embroidery device 2 has been mounted on the sewing machine 1. The embroidery device 2 can be mounted on and removed from the bed 11 of the sewing machine 1. FIG. 7 shows the embroidery device 2 in a state in which the embroidery device 2 is not mounted on the sewing machine 1. The embroidery device 2 includes a body 51 and a carriage 52.

As shown in FIG. 7, the body 51 of the embroidery device 2 is provided with a connecting portion 54 on a right side face of the embroidery device 2. In a state in which the embroidery device 2 is mounted on the sewing machine 1, the connecting portion 54 connects to a socket portion (not shown in the drawings) of the sewing machine 1, and the embroidery device 2 is electrically connected to the sewing machine 1.

The carriage 52 is provided on the top side of the body 51. The carriage 52 has a rectangular parallelepiped shape that is long in the front-rear direction. The carriage 52 includes a frame holder 55, a Y axis moving mechanism (not shown in the drawings), and a Y axis motor (not shown in the drawings). The frame holder 55 is a holder on which an embroidery frame (not shown in the drawings) can be removably mounted. The frame holder 55 is provided on the right side face of the carriage 52. The embroidery frame is a known frame that is configured from an inner frame and an outer frame. The embroidery frame is configured to hold the work cloth 100 by clamping the work cloth 100. The work cloth 100 that is held in the embroidery frame is positioned on the top side of the bed 11 and below the needle bar 29 and the presser foot 30. The Y axis moving mechanism may move the frame holder 55 in the front-rear direction (the Y axis direction). The embroidery frame may move the work cloth 100 in the front-rear direction as the frame holder 55 is moved in the front-rear direction. The Y axis motor (not shown in the drawings) may drive the Y axis moving mechanism. The CPU 61 (refer to FIG. 5) may control the Y axis motor.

An X axis moving mechanism (not shown in the drawings) and an X axis motor (not shown in the drawings) that may move the carriage 52 in the left-right direction (the X axis direction) are provided in the interior of the body 51. The embroidery frame may move the work cloth 100 in the left-right direction as the carriage 52 is moved in the left-right direction. The X axis motor (not shown in the drawings) may drive the X axis moving mechanism. The CPU 61 may control the X axis motor.

Figure 8:
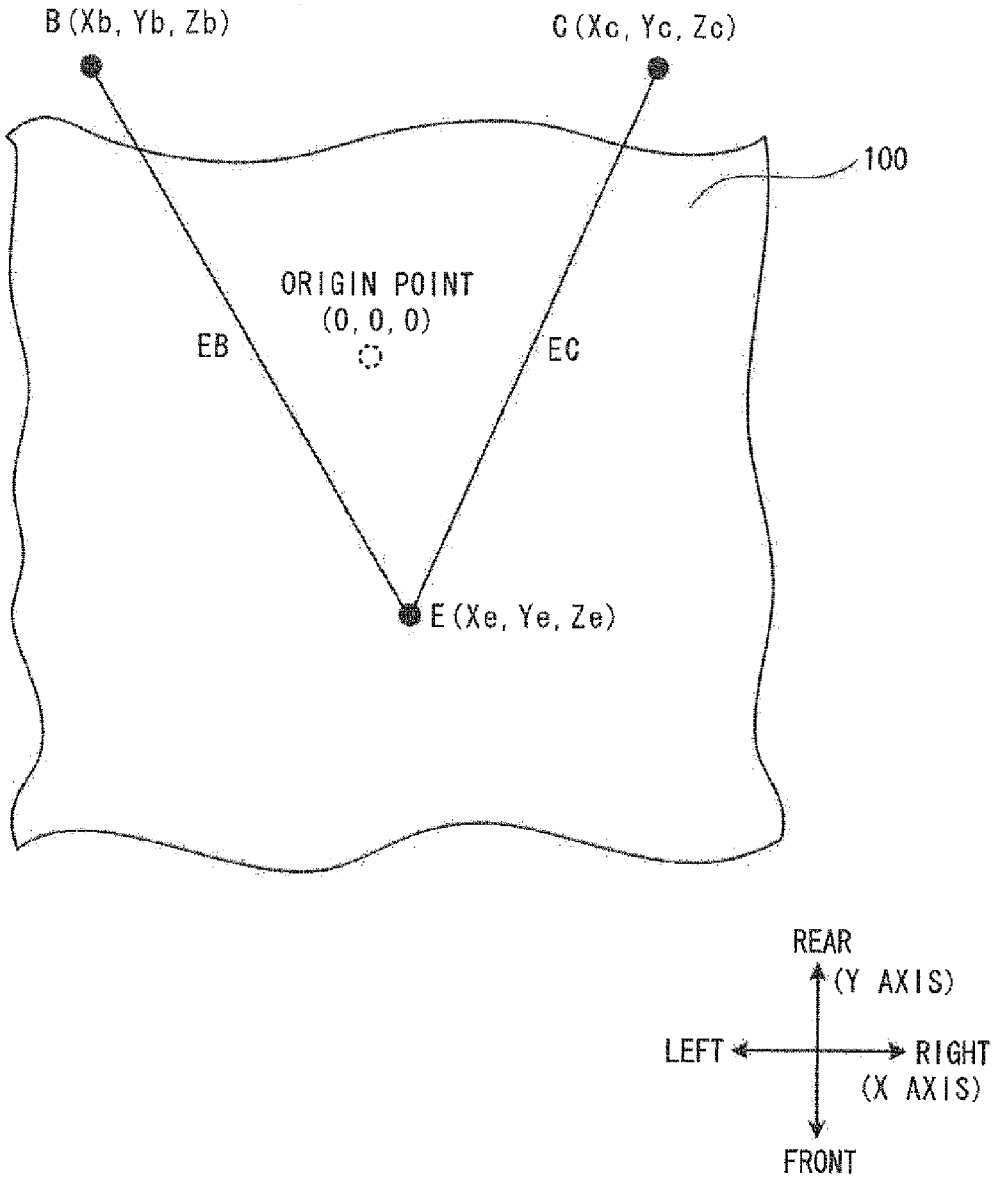
FIG. 8 is an explanatory figure of a method for computing designated coordinates.
Figure 9:
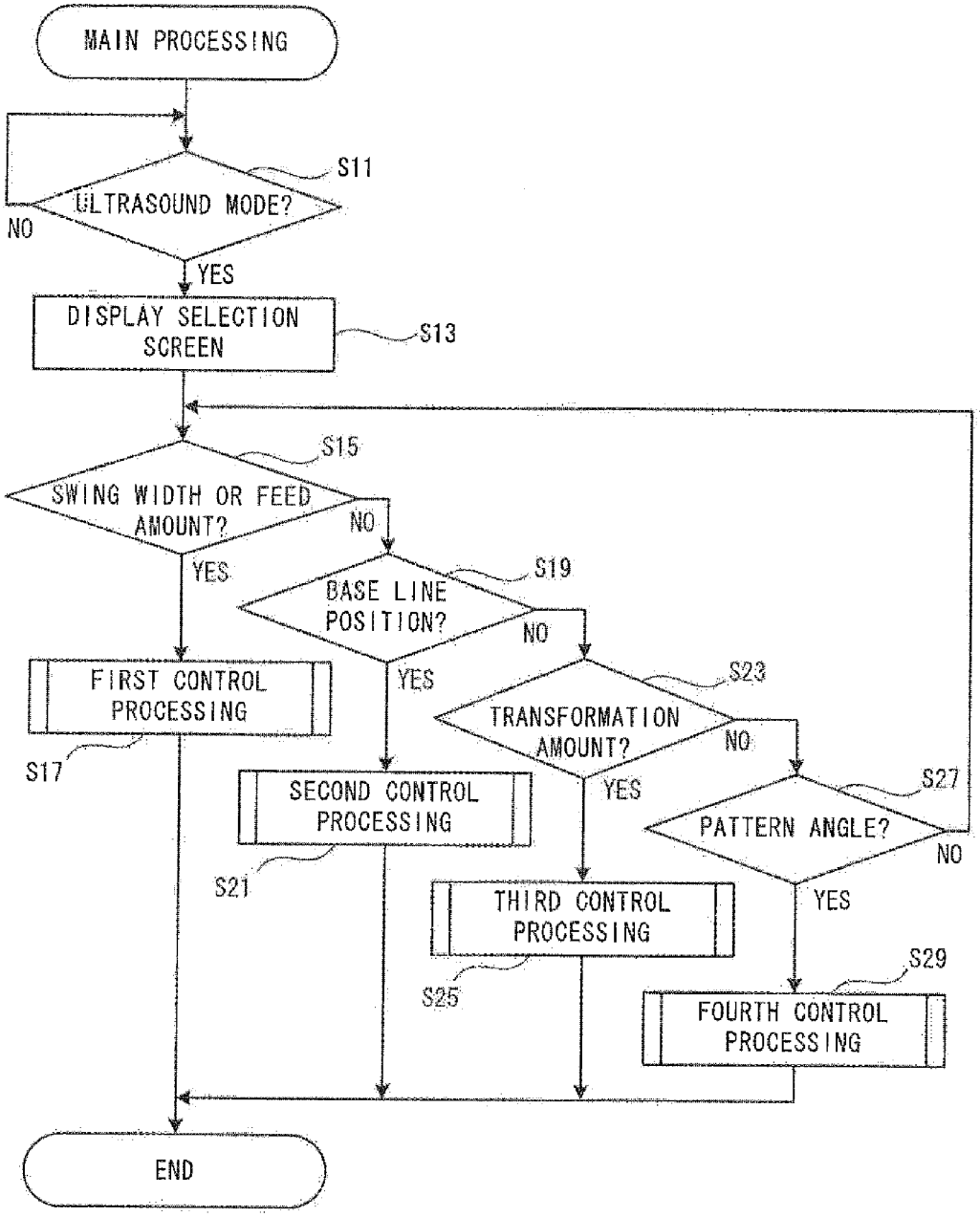
FIG. 9 is a flowchart that shows main processing.

A method for specifying a position on the work cloth 100 that the user has designated with the ultrasound pen 91 will be explained with reference to FIG. 8. By pressing the pen tip 911 of the ultrasound pen 91 against the work cloth 100, the user can designate a specific position on the work cloth 100. Hereinafter, the position on the work cloth 100 against which the pen tip 911 of the ultrasound pen 91 has been pressed is referred to as a designated position. Note that, as will be described later, the sewing machine 1 can specify the designated position by specifying the position of the transmission source of the ultrasonic waves. Therefore, in a precise sense, the position that is specified as the designated position is not the position on the work cloth 100 against which the pen tip 911 is pressed, but is the position of the ultrasound transmitter 915 that is provided in the ultrasound pen 91. However, the pen tip 911 and the ultrasound transmitter 915 are located extremely close to one another. Therefore, in the present embodiment, the position of the ultrasound transmitter 915 is regarded as the position on the work cloth 100 against which the pen tip 911 is pressed, that is, as the designated position. Hereinafter, the left-right direction, the front-rear direction, and the up-down direction in the sewing machine 1 are respectively defined as the X axis direction, the Y axis direction, and the Z axis direction. The left-right direction and the up-down direction in FIG. 8 are respectively equivalent to the X axis direction and the Y axis direction.

The sewing machine 1 may specify the designated position in the form of coordinate information (an X coordinate, a Y coordinate, and a Z coordinate). In the present embodiment, an example is used in which the origin point (0, 0, 0) of the coordinate system is the center point of a hole (a needle hole) through which the sewing needle may pass. The needle hole is formed in the needle plate 34 (refer to FIG. 1). The plane on which the Z coordinate is zero is equivalent to the top face of the needle plate 34. Coordinates B that indicate the position of the receiver 94 are defined as (Xb, Yb, Zb). Coordinates C that indicate the position of the receiver 95 are defined as (Xc, Ye, Zc). Coordinates E that indicate the designated position are defined as (Xe, Ye, Ze). The respective Z coordinates of the receivers 94, 95 indicate the heights of the receivers 94, 95 in relation to the top face of the needle plate 34. The coordinates B (Xb, Yb, Zb) and the coordinates C (Xc, Ye, Zc) are stored in the ROM 62 in advance. Hereinafter, the coordinates E are also referred to as the designated coordinates E. The distance between the designated coordinates E and the coordinates B will be referred to as the distance EB. The distance between the designated coordinates E and the coordinates C is referred to as the distance EC.

Based on the Pythagorean theorem, the distances EB, EC can be described by the coordinates B, C, E. The relationship between the distance EB and the coordinates B, C, E is described by Equation (1) below. In the same manner, the relationship between the distance EC and the coordinates B, C, E is described by Equation (2) below.

$$(Xb-Xe)^2+(Yb-Ye)^2+(Zb-Ze)^2=(EB)^2 \quad (1):$$

$$(Xc-Xe)^2+(Yc-Ye)^2+(Zc-Ze)^2=(EC)^2 \quad (2):$$

Note that Equation (1) is identical to an equation for a spherical surface (with a radius of the distance EB) for which the coordinates B define the origin point and that intersects the designated coordinates E. In the same manner, Equation (2) is identical to an equation for a spherical surface (with a radius of the distance EC) for which the coordinates C define the origin point and that intersects the designated coordinates E.

The velocity at which the ultrasonic waves travel is referred to as the velocity of sound V. The time that is required for the ultrasonic waves that are transmitted from the ultrasound pen 91 that is at the designated coordinates E to arrive at the receiver 94 is referred to as a transmission time Tb. The time that is required for the ultrasonic waves that are transmitted from the ultrasound pen 91 that is at the designated coordinates E to arrive at the receiver 95 is referred to as a transmission time Tc. In this case, the distances EB, EC can respectively be described by Equations (3) and (4) below.

$$EB=V\times Tb \quad (3):$$

$$EC=V\times Tc \quad (4):$$

Substituting Equations (3) and (4) into Equations (1) and (2) yields Equations (5) and (6) below.

$$(Xb-Xe)^2+(Yb-Ye)^2+(Zb-Ze)^2=(V\times Tb)^2 \quad (5):$$

$$(Xc-Xe)^2+(Yc-Ye)^2+(Zc-Ze)^2=(V\times Tc)^2 \quad (6):$$

In Equations (5) and (6), the coordinates B (Xb, Yb, Zb), the coordinates C (Xe, Yc, Zc) and the velocity of sound V are known values, and each of those values has been stored in the ROM 62. The transmission times Tb, Tc may be specified by computing the difference between the time that the ultrasonic waves are transmitted from the ultrasound transmitter 915 of the ultrasound pen 91 and the time that the ultrasonic waves are detected by the receivers 94, 95. Hereinafter, the time when the ultrasonic waves are transmitted from the ultrasound transmitter 915 of the ultrasound pen 91 is referred to as the transmission time T1. The pair of times when the ultrasonic waves are detected by the receivers 94, 95, respectively, are referred to as the detection times T2. Among the designated coordinates E (Xe, Ye, Ze), Ze is a value that is determined by the thickness of the work cloth 100. Therefore, the range of values that Ze can have is smaller than the ranges of values that Xe and Ye can respectively have. Therefore, in the present embodiment, the value of Ze is regarded as being zero. Accordingly, the respective values for Xe and Ye are computed by solving the simultaneous Equations (5) and (6). In this manner, the designated coordinates E (Xe, Ye, Ze (=0)) that the user has used the ultrasound pen 91 to designate on the work cloth 100 are computed.

In the present embodiment, by pressing the pen tip 911 of the ultrasound pen 91 against the work cloth 100, the user is able to specify a swing width, the feed amount, a base line position, a pattern angle, and a transformation amount (or a transformation ratio) to the sewing machine 1. Hereinafter, the swing width, the feed amount, the base line position, the pattern angle, the transformation amount, and the transformation ratio are collectively referred to as sewing information. The swing width is the length in the left-right direction of a stitch that is formed by performing the sewing while the sewing machine 1 swings the needle bar 29 to the left and to the right. The feed amount is an amount that the feed dog moves the work cloth 100, and the amount is equivalent to the length of one stitch. The base line position indicates a needle drop position, in the left-right direction, for the sewing needle when the sewing is performed, and the base line position is also referred to as the base line position for the needle bar 29. Note that, the needle drop position is a position where the sewing needle pierces the work cloth 100. The pattern angle indicates a slant of a decorative pattern or an embroidery pattern that is sewn on the work cloth 100. The transformation amount is an amount by which the size or shape of a decorative pattern or an embroidery pattern is transformed. The transformation ratio may be used instead of the transformation amount. The transformation ratio is a ratio by which the size or shape of a decorative pattern or an embroidery pattern is transformed. The sewing machine 1 may detect the ultrasonic waves that have been transmitted from the ultrasound pen 91 and specify the designated position based on the detected ultrasonic waves. The sewing machine 1 may specify sewing information based on the designated position which has been specified. The sewing machine 1 may perform sewing based on the specified sewing information. The user is able to designate various types of the sewing information for the sewing machine 1 by using the ultrasound pen 91 to designate a position on the work cloth 100. The user is able to designate the sewing information directly on the work cloth 100. Therefore, the user is able to designate the sewing information while preconceiving the finished state of a stitch or an embroidery pattern that is sewn on the work cloth 100. The sewing machine 1 is able to sew a stitch or an embroidery pattern on the work cloth 100 based on the designated sewing information. This will be explained in detail.

Main processing will be explained with reference to FIGS. 9 to 13. The main processing may be performed by the CPU 61 in accordance with a program that is stored in the ROM 62. The CPU 61 starts the main processing in a case where, for example, the user has used a panel operation to input a command to perform sewing on the work cloth 100.

The CPU 61 determines whether a panel operation has been detected that shifts the sewing machine 1 to an ultrasound mode (Step S11). The ultrasound mode is an operating mode in which the sewing machine 1 is able to detect the ultrasonic waves that have been transmitted from the ultrasound pen 91. In a case where the panel operation that shifts the sewing machine 1 to the ultrasound mode has not been detected (NO at Step S11), the CPU 61 returns the processing to Step S11.

In a case where the panel operation that shifts the sewing machine 1 to the ultrasound mode has been detected (YES at Step S11), the CPU 61 displays a sewing information selection screen on the LCD 15 (Step S13). The sewing information selection screen is a screen on which the user is able to select one of the swing width, the feed amount, the base line position, the transformation amount, and the pattern angle as the sewing information. The swing width, the feed amount, and the base line position are valid sewing information in a case where the sewing machine 1 alone performs sewing of an ordinary pattern. The ordinary pattern includes, for example, a straight line stitch, a zigzag stitch, an overcast stitch, a decorative pattern, a buttonhole stitch, and the like. Therefore, a screen that the sewing machine 1 is able to accept a panel operation that selects one of the swing width, the feed amount, and the base line position may be displayed in a case where the sewing machine 1 has been set to an ordinary sewing mode. The ordinary sewing mode is an operating mode in which the sewing machine 1 is able to perform sewing of the ordinary pattern. On the other hand, the transformation amount and the pattern angle are valid sewing information in a case where an embroidery pattern is sewn on the work cloth 100 by the embroidery device 2. Therefore, a screen that the sewing machine 1 is able to accept a panel operation that selects one of the transformation amount and the pattern angle may be displayed in a case where the embroidery device 2 has been mounted on the sewing machine 1 (refer to FIG. 6).

The CPU 61 determines whether a panel operation that selects one of the swing width and the feed amount has been detected (Step S15). In a case where the CPU 61 has detected a panel operation that selects one of the swing width and the feed amount (YES at Step S15), the CPU 61 performs first control processing (refer to FIG. 10) (Step S17). Note that, the CPU 61 stores data that indicate the selection of the panel operation in the RAM 63. In the present embodiment, the stored data are equivalent to data that indicate one of the swing width and the feed amount has been selected. The first control processing is processing in which the CPU 61 specifies one of the swing width and the feed amount based on the ultrasonic waves that have been detected through the receivers 94, 95, causing the sewing machine 1 to perform the sewing of an ordinary pattern on the work cloth 100 based on the specified one of the swing width and the feed amount. The first control processing is performed in a state in which the sewing machine 1 has been set to the ordinary sewing mode. The first control processing will be described in detail later.

After the first control processing is terminated, the CPU 61 terminates the main processing.

In a case where the CPU 61 has not detected a panel operation that selects one of the swing width and the feed amount (NO at Step S15), the CPU 61 determines whether a panel operation that selects the base line position has been detected (Step S19). In a case where the CPU 61 has detected a panel operation that selects the base line position (YES at Step S19), the CPU 61 performs second control processing (refer to FIG. 11) (Step S21). The second control processing is processing in which the CPU 61 specifies the base line position based on the ultrasonic waves that have been detected through the receivers 94, 95, causing the sewing machine 1 to perform the sewing of an ordinary pattern at the specified base line position. The second control processing is performed in a state in which the sewing machine 1 has been set to the ordinary sewing mode. The second control processing will be described in detail later. After the second control processing is terminated, the CPU 61 terminates the main processing.

In a case where the CPU 61 has not detected a panel operation that selects the base line position (NO at Step S19), the CPU 61 determines whether a panel operation that selects the transformation amount has been detected (Step S23). In a case where the CPU 61 has detected a panel operation that selects the transformation amount (YES at Step S23), the CPU 61 performs third control processing (refer to FIG. 12) (Step S25). The third control processing is processing in which the CPU 61 specifies the transformation amount based on the ultrasonic waves that have been detected through the receivers 94, 95, causing the sewing machine 1 to sew, on the work cloth 100, an embroidery pattern that has been transformed based on the specified transformation amount. The third control processing is performed in a state in which the embroidery device 2 has been mounted on the sewing machine 1. The third control processing will be described in detail later. After the third control processing is terminated, the CPU 61 terminates the main processing.

In a case where the CPU 61 has not detected a panel operation that selects the transformation amount (NO at Step S23), the CPU 61 determines whether a panel operation that selects the pattern angle has been detected (Step S27). In a case where the CPU 61 has detected a panel operation that selects the pattern angle (YES at Step S27), the CPU 61 performs fourth control processing (refer to FIG. 13) (Step S29). The fourth control processing is processing in which the CPU 61 specifies the pattern angle based on the ultrasonic waves that have been detected through the receivers 94, 95, causing the sewing machine 1 to sew, on the work cloth 100, an embroidery pattern that has been rotated based on the specified pattern angle. The fourth control processing is performed in a state in which the embroidery device 2 has been mounted on the sewing machine 1. The fourth control processing will be described in detail later. After the fourth control processing is terminated, the CPU 61 terminates the main processing. In a case where the CPU 61 has not detected a panel operation that selects the pattern angle (NO at Step S27), the CPU 61 returns the processing to Step S15.

Figure 10:
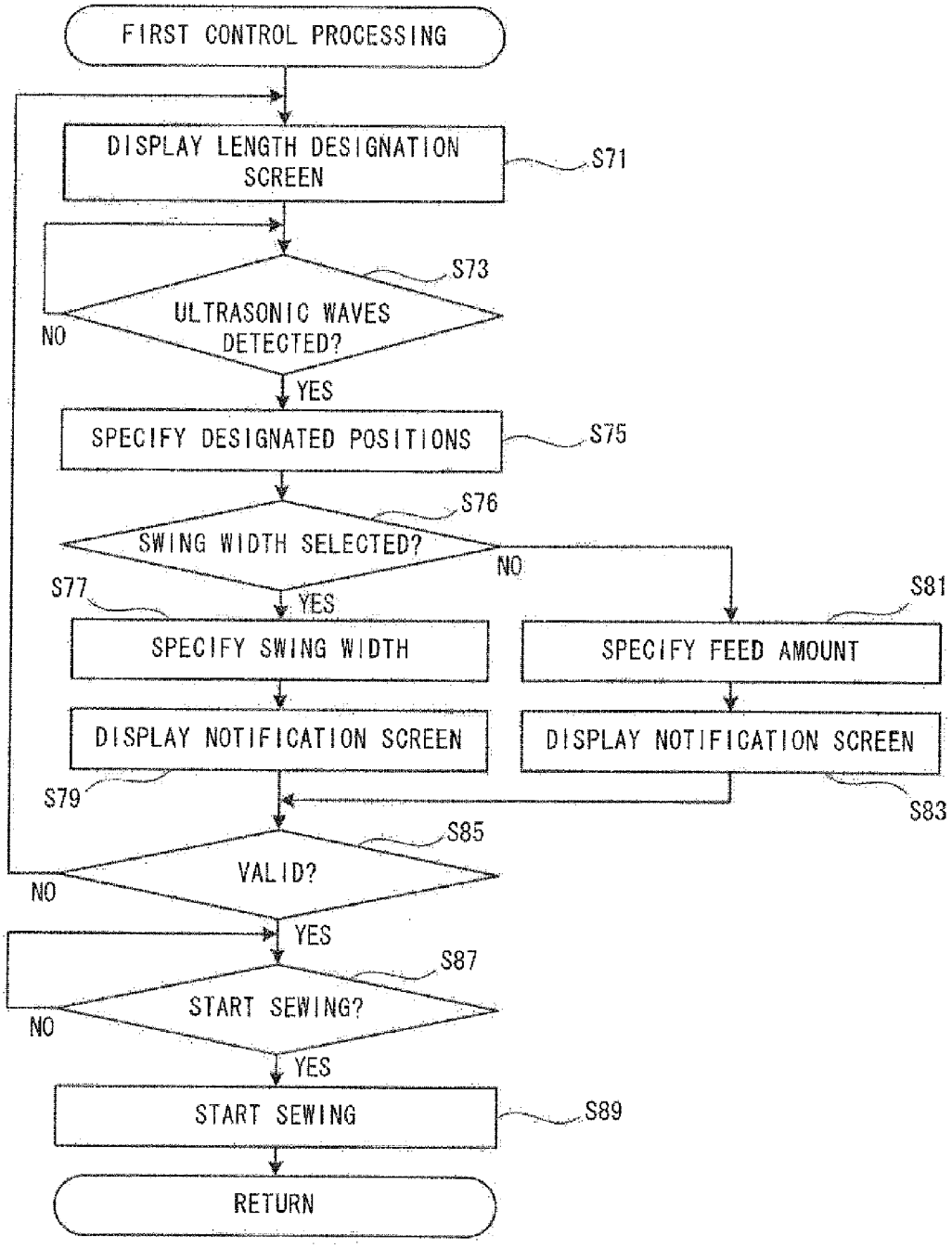
FIG. 10 is a flowchart that shows first control processing.
Figure 14:
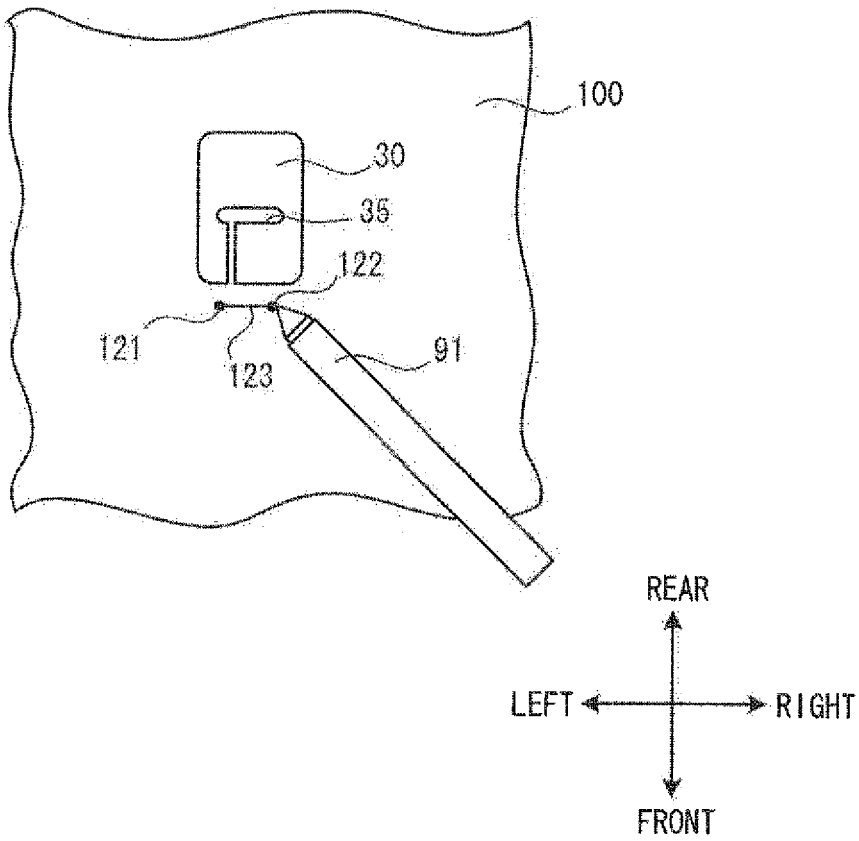
FIG. 14 is an explanatory figure of a method for using an ultrasound pen to designate a swing width.

The first control processing will be explained with reference to FIG. 10. The CPU 61 displays a length designation screen on the LCD 15 (Step S71). The length designation screen is a screen that indicates that the sewing machine 1 is able to designate one of the swing width and the feed amount based on the ultrasonic waves that are transmitted from the ultrasound pen 91. For example, by pressing the pen tip 911 of the ultrasound pen 91 against two points (points 121, 122) on the work cloth 100 that are separated from one another in the left-right direction, as shown in FIG. 14, the user can specify the distance between the points 121, 122 as the swing width. Note that for the feed amount, by pressing the pen tip 911 of the ultrasound pen 91 in the same manner against two points on the work cloth 100 that are separated from one another in the front-rear direction, the user can specify the distance between the two points as the feed amount, although this is not shown in the drawings. As shown in FIG. 10, the CPU 61 determines whether the ultrasonic waves have been detected through the receivers 94, 95 (Step S73). In a case where the ultrasonic waves have not been detected through the receivers 94, 95 (NO at Step S73), the CPU 61 returns the processing to Step S73.

In a case where the pen tip 911 of the ultrasound pen 91 is pressed against two points on the work cloth 100, the signal output circuit 914 of the ultrasound pen 91 outputs the electrical signal through the cable 912 at the time when the pen tip 911 is pressed against each one of the points. At the same time that the electrical signal is output, the ultrasound transmitter 915 of the ultrasound pen 91 transmits the ultrasonic waves. The CPU 61 detects the electrical signal that has been output from the ultrasound pen 91 through the cable 912. The CPU 61 specifies the time when the electrical signal was detected for each of the two points as the transmission time T1. After specifying the transmission time T1, the CPU 61 detects the ultrasonic waves through the receivers 94, 95. The CPU 61 specifies the pair of times when the receivers 94, 95 detect the ultrasonic waves as the detection times T2.

In a case where the ultrasonic waves have been detected from the two points through the receivers 94, 95 (YES at Step S73), the CPU 61 specifies the designated position for each of the two points by computing the designated coordinates E for each of the two points based on the corresponding transmission time T1 and the corresponding pair of the detection times T2 (Step S75). The CPU 61 refers to the data that indicate the selection of the panel operation stored in the RAM 63 at Step S15, and determines whether the sewing width was selected at Step S15 (Step S76). In a case where the swing width was selected at Step S15 (refer to FIG. 9) (YES at Step S76), the CPU 61 specifies the length between the specified designated positions of the two points as the swing width (Step S77). The CPU 61 displays a swing width notification screen on the LCD 15 (Step S79). The swing width notification screen is a screen that notifies the user of the specified swing width and on which the user can input whether the swing width of which the user has been notified is valid or invalid. The CPU 61 advances the processing to Step S85. On the other hand, in a case where the feed amount was selected at Step S15 (NO at Step S76), the CPU 61 specifies the length between the specified designated positions of the two points as the feed amount (Step S81). The CPU 61 displays a feed amount notification screen on the LCD 15 (Step S83). The feed amount notification screen is a screen that notifies the user of the specified feed amount and on which the user can input whether the feed amount of which the user has been notified is valid or invalid. The CPU 61 advances the processing to Step S85.

The user is able to check whichever one of the swing width notification screen and the feed amount notification screen is displayed on the LCD 15. The user can use a panel operation to input to the sewing machine 1 whether the displayed one of the specified swing width and the specified feed amount is valid or invalid. The CPU 61 determines whether a panel operation has been detected that indicates that the displayed one of the specified swing width and the specified feed amount is valid (Step S85). In a case where the CPU 61 has detected a panel operation that indicates that the displayed one of the swing width and the feed amount is invalid (NO at Step S85), in order to restart the processing for specifying the one of the swing width and the feed amount from the beginning, the CPU 61 returns the processing to Step S71.

On the other hand, in a case where a panel operation has been detected that indicates that the displayed one of the swing width and the feed amount is valid (YES at Step S85), the CPU 61 determines whether an operation of the start-and-stop switch (among the operation switches 21) has been detected that issues a command to start sewing (Step S87). In a case where the operation of the start-and-stop switch has not been detected (NO at Step S87), the CPU 61 returns the processing to Step S87. In a case where the operation of the start-and-stop switch has been detected (YES at Step S87), the CPU 61 causes the sewing machine 1 to start the sewing on the work cloth 100 as hereinafter described.

In a case where the swing width was specified at Step S77, the CPU 61 controls the swinging mechanism by operating the swinging motor 80. The swinging mechanism swings the needle bar 29 to the left and to the right in accordance with the specified swing width. In a case where the feed amount was specified at Step S81, the CPU 61 controls the amount of movement of the feed dog by operating the feed adjustment motor 83. The feed dog moves the work cloth 100 toward the rear (or toward the front) in increments of the specified feed amount. The CPU 61 moves the needle bar 29 up and down by operating the sewing machine motor 79. By operating both the feed adjustment motor 83 and the sewing machine motor 79, the CPU 61 causes the sewing machine 1 to start the sewing on the work cloth 100 (Step S89). The first control processing is terminated, and the CPU 61 returns the processing to the main processing (refer to FIG. 9). In the first control processing, the CPU 61 may also perform the processing that specifies the feed amount after the CPU 61 performs the processing that specifies the swing width.

As described above, by using the pen tip 911 of the ultrasound pen 91 to designate positions on the work cloth 100, the user is able to designate at least one of the swing width and the feed amount for the sewing machine 1. The user can designate the one of the swing width and the feed amount directly on the work cloth 100 by using the ultrasound pen 91. The sewing machine 1 is able to sew an ordinary pattern on the work cloth 100 based on the one of the swing width and the feed amount that has been designated by the user.

For example, in a case where the sewing machine 1 performs the sewing of a zigzag pattern, the swing width is equivalent to the width of the zigzag pattern. By using the ultrasound pen 91 to designate the swing width, the user is able to set the width of the zigzag pattern that the sewing machine 1 sews. For example, in a case where the sewing machine 1 performs the sewing of a straight line stitch, the feed amount is equivalent to the length of one stitch. By using the ultrasound pen 91 to designate the feed amount, the user is able to set the length of the straight line stitch that the sewing machine 1 sews. Thus, the user can designate the sewing information in cases where the sewing machine 1 sews an ordinary pattern on the work cloth 100.

Note that the sewing machine 1 may also receive the designating of the swing width and the feed amount by another method. For example, the sewing machine 1 may also receive the designated one of the swing width and the feed amount as will be described. As shown in FIG. 14, the user presses the ultrasound pen 91 against the work cloth 100 and describes a line segment 123 of a length that is equivalent to the swing width. Based on the transmission time T1 and the pair of the detection times T2, the CPU 61 specifies, as the designated position, the position of the point 121, which is the starting point of the line segment 123 that is described by the ultrasound pen 91 on the work cloth 100. The CPU 61 also specifies a time T3 when the electrical signal from the ultrasound pen 91 ceases to be detected and a pair of times T4 when the ultrasonic waves from the ultrasound pen 91 cease to be detected. Based on the times T3, T4, the CPU 61 may use the same sort of method which is used in specifying the designated position to specify the position of the point 122. The point 122 is the ending point of the line segment 123 that is described by the ultrasound pen 91 on the work cloth 100. The CPU 61 computes the distance between the designated points 121, 122. The CPU 61 specifies the computed distance as the swing width. The CPU 61 may also specify the feed amount by the same sort of method as that described above.

Note that in FIG. 14, the one of the swing width and the feed amount is designated by the pressing of the ultrasound pen 91 against the work cloth 100 in the area close to the presser foot 30. However, the position at which the ultrasound pen 91 can be pressed against the work cloth 100 is not limited to the area close to the presser foot 30. Nonetheless, it is preferable for the swing width that can be designated to be not greater than a specified length (for example, 7 millimeters). The specified length is the maximum value of the value that can be set as the swing width for the needle bar by the swinging mechanism's swinging of the needle bar 29. Furthermore, the specified length is slightly shorter than the length in the left-right direction of a hole 35 that is provided in the presser foot 30, extending in the left-right direction. Therefore, in order for the user to designate the swing width within a range that is not greater than the specified length, it is preferable for the user to press the ultrasound pen 91 against the work cloth 100 in the area close to the presser foot 30 while looking at the hole 35 that is provided in the presser foot 30. Note that in FIG. 14 and in FIG. 15, which will be described later, the shape of the presser foot 30 has been simplified.

Figure 11:
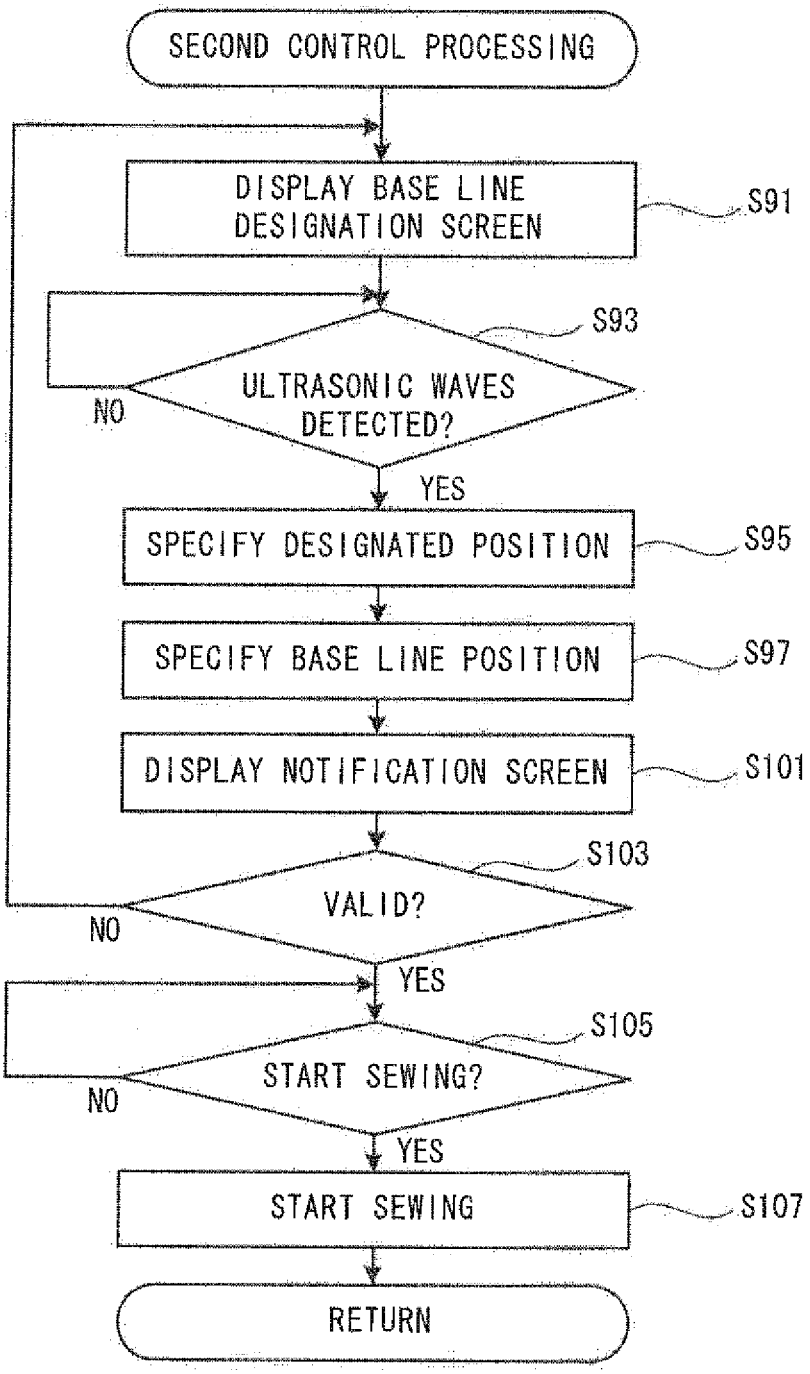
FIG. 11 is a flowchart that shows second control processing.
Figure 15:
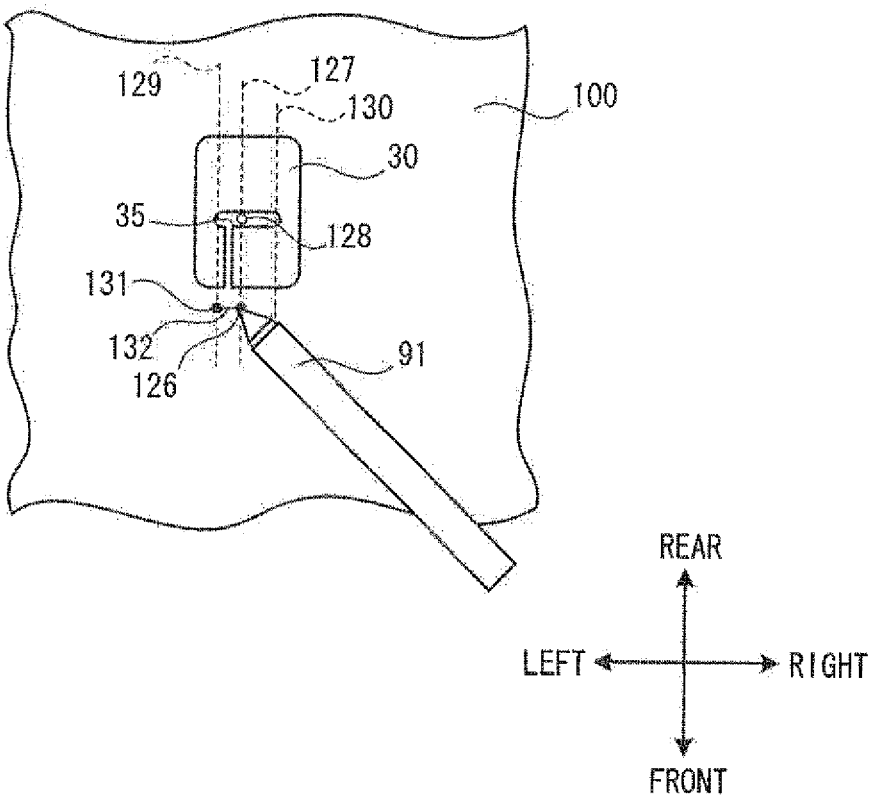
FIG. 15 is an explanatory figure of a method for using the ultrasound pen to designate a base line position.

The second control processing will be explained with reference to FIG. 11. Explanations will be omitted or simplified for processing that is the same as the first control processing (refer to FIG. 10). The CPU 61 displays a base line designation screen on the LCD 15 (Step S91). The base line designation screen is a screen that indicates that the sewing machine 1 is in a state in which the sewing machine 1 is able to designate the base line based on the ultrasonic waves that are transmitted from the ultrasound pen 91. For example, by pressing the pen tip 911 of the ultrasound pen 91 against a point 126 in the area close to the presser foot 30, as shown in FIG. 15, the user can designate the base line position such that the needle drop position for the sewing needle is disposed on a virtual straight line 127 that passes through the point 126 in the front-rear direction. In this case, a point 128, where the virtual straight line 127 intersects the center of the hole 35 in the front-rear direction, is equivalent to a needle drop point (the needle drop position) where the sewing needle may pierce the work cloth 100. The hole 35 is the hole that is formed in the presser foot 30, extending in the left-right direction. As shown in FIG. 11, the CPU 61 determines whether the ultrasonic waves have been detected through the receivers 94, 95 (Step S93). In a case where the ultrasonic waves have not been detected (NO at Step S93), the CPU 61 returns the processing to Step S93.

In a case where the user has pressed the pen tip 911 of the ultrasound pen 91 against the work cloth 100 in order to designate the base line position, the CPU 61 specifies the transmission time T1. The CPU 61 also detects the ultrasonic waves through the receivers 94, 95 (YES at Step S93) and specifies the pair of the detection times T2. The CPU 61 specifies the designated position by computing the designated coordinates E based on the transmission time T1 and the pair of the detection times T2 (Step S95). The CPU 61 specifies the base line position based on the designated position which has been specified (Step S97). The CPU 61 displays a base line position notification screen on the LCD 15 (Step S101). The base line position notification screen is a screen that notifies the user of the specified base line position and on which the user can input whether or not the base line position of which he has been notified is valid or invalid. The CPU 61 determines whether a panel operation has been detected that indicates that the base line position is valid (Step S103). In a case where a panel operation has been detected that indicates that the base line position is invalid (NO at Step S103), in order to restart the processing for specifying the base line position from the beginning, the CPU 61 returns the processing to Step S91.

In a case where a panel operation has been detected that indicates that the base line position is valid (YES at Step S103), the CPU 61 determines whether the operation of the start-and-stop switch (among the operation switches 21) has been detected that issues the command to start sewing (Step S105). In a case where the operation of the start-and-stop switch has not been detected (NO at Step S105), the CPU 61 returns the processing to Step S105. In a case where the operation of the start-and-stop switch has been detected (YES at Step S105), the CPU 61 controls the swinging mechanism by operating the swinging motor 80. The CPU 61 causes the swinging mechanism to move the needle bar 29 to the left (or to the right) and then to stop the needle bar 29 above the specified base line position. According to this controlling, the needle drop position of the sewing needle is disposed on the specified base line. The CPU 61 moves the needle bar 29 up and down by operating the sewing machine motor 79 and moves the work cloth 100 by operating the feed dog. The CPU 61 thus causes the sewing machine 1 to start the sewing on the work cloth 100 (Step S107). The second control processing is terminated, and the CPU 61 returns the processing to the main processing (refer to FIG. 9).

As described above, by using the pen tip 911 of the ultrasound pen 91 to designate a position on the work cloth 100, the user is able to designate the base line position for the sewing machine 1. The user can designate the base line position directly on the work cloth 100 by using the ultrasound pen 91. The sewing machine 1 is able to sew an ordinary pattern, such as a straight line stitch, for example, on the work cloth 100 in the position that the user designates.

Note that the sewing machine 1 may also receive the designating of the base line position by another method. For example, the user may designate the base line position for the sewing machine 1 as will be described. The user may use the ultrasound pen 91 to describe a line segment 132 on the work cloth 100, as shown in FIG. 15. By the same sort of method as in the modified example of the first control processing, the CPU 61 specifies the length of the line segment 132 that is described on the work cloth 100 between a point 131, which is the starting point of the line segment 132, and the point 126, which is the ending point. The CPU 61 specifies, as the base line position, a position that is offset to the right, by the length of the specified line segment 132, from a left base line 129 that passes through the point 131 and extends in the front-rear direction. Note that a right base line 130 may be used instead of the left base line 129.

Note that in FIG. 15, the base line position is designated by the pressing of the ultrasound pen 91 against the work cloth 100 in the area close to the presser foot 30. However, the position at which the ultrasound pen 91 is pressed against the work cloth 100 is not limited to the area close to the presser foot 30. Nevertheless, in a case where the user designates the base line position while looking at the hole 35 that is provided in the presser foot 30, it is preferable for the position where the ultrasound pen 91 is pressed against the work cloth 100 to be in the area close to the presser foot 30.

The third control processing will be explained with reference to FIG. 12. The CPU 61 displays an embroidery pattern selection screen on the LCD 15 (Step S41). The embroidery pattern selection screen is a screen on which, by performing a panel operation, the user can select a pattern for the sewing machine 1 to sew. Coordinate data for the needle drop points that are required in order for the sewing machine 1 to sew the embroidery pattern that the user can select at Step S41 are stored in the ROM 62 (refer to FIG. 5) in advance. Hereinafter, the coordinate data that are required for sewing an embroidery pattern are referred to as pattern data. In a case where an embroidery pattern has been selected by a panel operation, the CPU 61 displays on the LCD 15 a screen that shows the selected embroidery pattern. In the present embodiment, an example will be used in which the embroidery pattern that has been selected is a character "A" 200. The CPU 61 displays a transformation amount designation screen on the LCD 15 (Step S43). The transformation amount designation screen is a screen that indicates that the sewing machine 1 is in a state in which the sewing machine 1 is able to designate the transformation amount based on the ultrasonic waves that are transmitted from the ultrasound pen 91.

Figure 16:
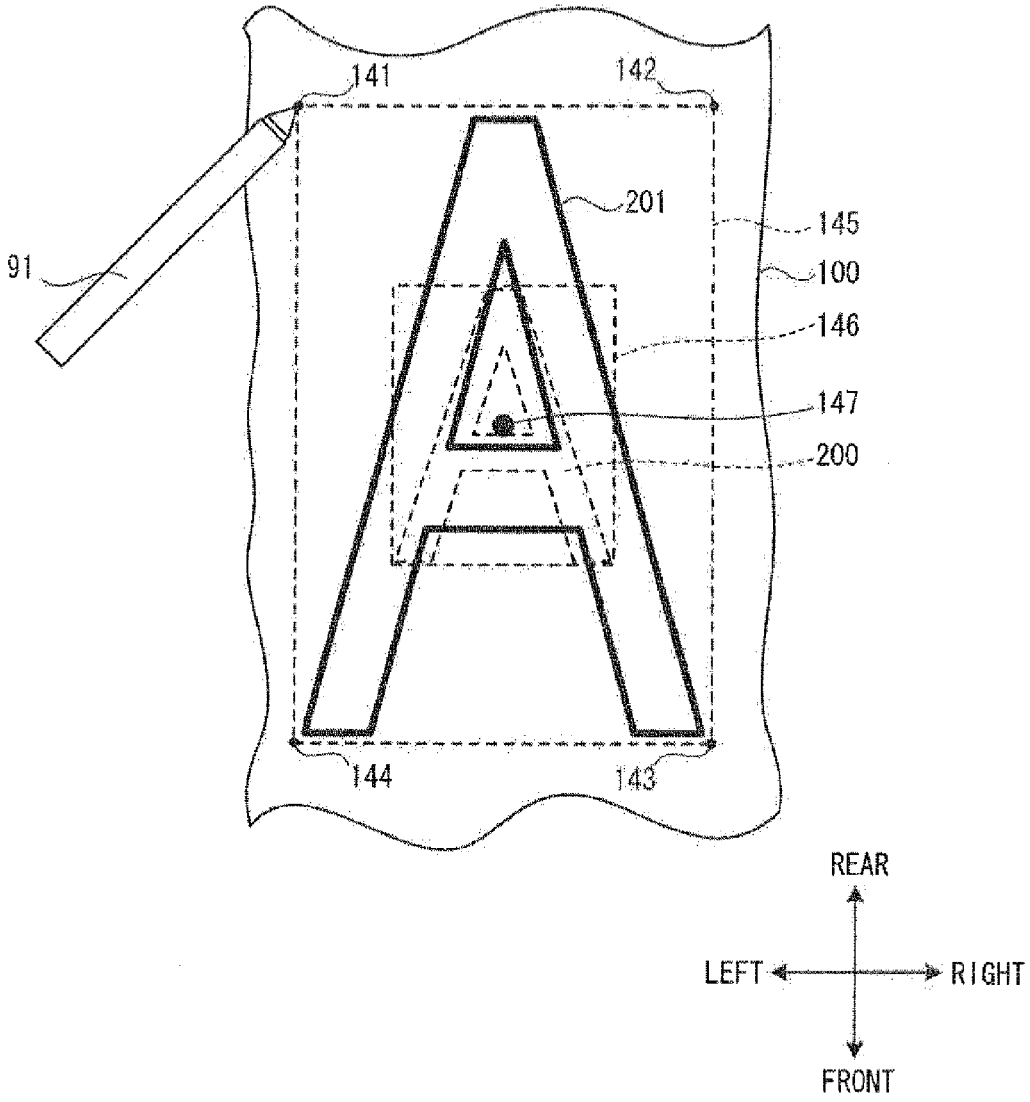
FIG. 16 is an explanatory figure of a method for using the ultrasound pen to designate a transformation amount.

For example, the user can designate the transformation amount for the embroidery pattern by pressing the pen tip 911 of the ultrasound pen 91 against the work cloth 100 at four points. For example, in the present embodiment, the default size of the character "A" 200 is the size that is indicated by a virtual rectangle 146 that is represented by a broken line, as shown in FIG. 16. In a case where the pen tip 911 of the ultrasound pen 91 has been pressed against the work cloth 100 at four points (points 141, 142, 143, 144), the character "A" 200 is transformed into a character "A" 201 of a size that fits exactly inside a rectangle 145 for which the four points (the points 141, 142, 143, 144) serve as vertices. The pattern data for the character "A" 200 include mask data and reference point data. The mask data are data that indicate the virtual rectangle 146, which is the smallest rectangle that can encompass the character "A" 200. The reference point data are data that indicate the position of a reference point 147, which is the center point of the virtual rectangle 146. The center point of the virtual rectangle 146 is the point of intersection of the two diagonals of the rectangle. The mask data may, for example, include data that indicate the positions of the four vertices of the virtual rectangle 146. The data that indicate the positions of the four vertices of the virtual rectangle 146 may be data that indicate the relative position of each of the four vertices in relation to the reference point 147, for example. In a case where the pen tip 911 has been pressed against the work cloth 100 at the points 141, 142, 143, 144, the character "A" is disposed such that the reference point 147 is coincident with the center (the point of intersection of the diagonals) of the rectangle 145. Specifically, the CPU 61 may specify the transformation amount based on the data that indicate the positions of the four vertices of the virtual rectangle 146 and on data that indicate the position of each of the points 141, 142, 143, 144, for example. Based on the specified transformation amount, the CPU 61 changes the pattern data for sewing the character "A" 200 into pattern data for sewing the character "A" 201. Note that the character "A" 201 indicates the embroidery pattern after the transformation, that is, the embroidery pattern that to actually be sewn on the work cloth 100.

Figure 12:
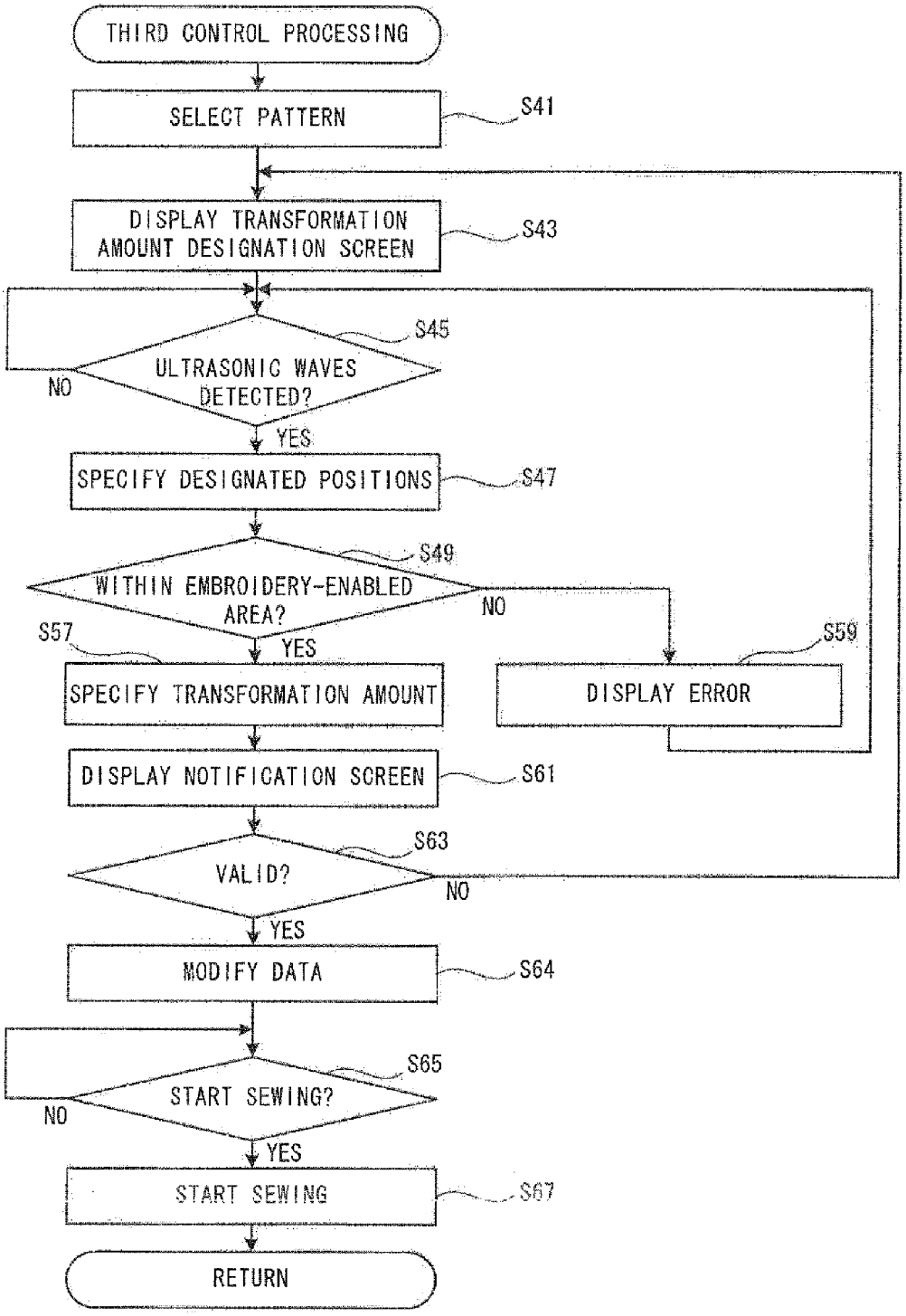
FIG. 12 is a flowchart that shows third control processing.

As shown in FIG. 12, the CPU 61 determines whether the ultrasonic waves have been detected through the receivers 94, 95 (Step S45). In a case where the ultrasonic waves have not been detected through the receivers 94, 95 (NO at Step S45), the CPU 61 returns the processing to Step S45. In a case where the user has pressed the pen tip 911 of the ultrasound pen 91 against the work cloth 100 at four points in order to designate the transformation amount, the CPU 61 detects the electrical signals that have been output from the ultrasound pen 91 and specifies the corresponding four transmission times T1. The CPU 61 also detects the ultrasonic waves through the receivers 94, 95 and specifies the corresponding four pairs of the detection times T2.

In a case where the ultrasonic waves from the four points have been detected through the receivers 94, 95 (YES at Step S45), the CPU 61 specifies the designated positions for the four points by computing the respective designated coordinates E based on the four corresponding transmission times T1 and the four corresponding pairs of the detection times T2 (Step S47). The CPU 61 determines whether all of the four designated positions that have been specified are located within an embroidery-enabled area (Step S49). The embroidery-enabled area is an area in which it is possible for the sewing machine 1 to perform the sewing of the embroidery pattern by using the embroidery device 2. The embroidery-enabled area may be a rectangular area for example. Data that indicate the positions of the four vertices of the embroidery-enabled area may be stored in the ROM 62, for example. In a case where at least one of the four designated positions that have been specified is located outside the embroidery-enabled area (NO at Step S49), the CPU 61 displays on the LCD 15 an error message that indicates that the designated positions that have been designated by the ultrasound pen 91 are invalid (Step S59). The user can check the error message and can once again designate the designated positions for the four points by using the ultrasound pen 91. The CPU 61 returns the processing to Step S45.

In a case where all of the four designated positions are located inside the embroidery-enabled area (YES at Step S49), the CPU 61 specifies the transformation amount by which the embroidery pattern is transformed such that the embroidery pattern fits exactly inside the rectangle 145, for which the four points that have been specified serve as vertices (Step S57).

The CPU 61 displays a transformation amount notification screen on the LCD 15 (Step S61). The transformation amount notification screen is a screen that notifies the user of the embroidery pattern that has been transformed by the specified transformation amount and on which the user can input whether the embroidery pattern of which the user has been notified is valid or invalid. The user may determine whether the transformed embroidery pattern is valid and use a panel operation to input the result of the determination to the sewing machine 1. The CPU 61 determines whether a panel operation has been detected that indicates that the transformed embroidery pattern is valid (Step S63). In a case where a panel operation has been detected that indicates that the transformed embroidery pattern is invalid (NO at Step S63), in order to restart the processing for specifying the transformation amount from the beginning, the CPU 61 returns the processing to Step S43.

In a case where a panel operation has been detected that indicates that the transformed embroidery pattern is valid (YES at Step S63), the CPU 61 takes the pattern data for the embroidery pattern that was selected at Step S41 and modifies the pattern data based on the transformation amount that was specified a Step S57 (Step S64).

The CPU 61 determines whether the operation of the start-and-stop switch (among the operation switches 21) has been detected that issues the command to start sewing (Step S65). In a case where the operation of the start-and-stop switch has not been detected (NO at Step S65), the CPU 61 returns the processing to Step S65. In a case where the operation of the start-and-stop switch has been detected (YES at Step S65), the CPU 61 starts processing that sews the transformed embroidery pattern on the work cloth 100 based on the pattern data that were modified at Step S64 (Step S67). The CPU 61 moves the embroidery frame in the left-right direction (the X axis direction) and the front-rear direction (the Y axis direction) by controlling the X axis motor and the Y axis motor of the embroidery device 2, and the CPU 61 moves the needle bar 29 up and down by operating the sewing machine motor 79. The sewing machine 1 can thus sew the transformed embroidery pattern on the work cloth 100 that is held in the embroidery frame. The third control processing is terminated, and the CPU 61 returns the processing to the main processing (refer to FIG. 9).

As described above, the user can use the pen tip 911 of the ultrasound pen 91 to designate positions on the work cloth 100. The sewing machine 1 can set the transformation amount for the embroidery pattern based on the positions that have been designated by the pen tip 911. The user can designate the transformation amount for the embroidery pattern directly on the work cloth 100 by using the ultrasound pen 91. The sewing machine 1 is able to sew on the work cloth 100 the embroidery pattern that has been transformed based on the designated transformation amount.

Note that the sewing machine 1 may also receive the designating of the transformation amount by another method. The shape that is defined by the four points that are designated by the ultrasound pen 91 is not limited to being a rectangle, as shown in FIG. 16, and it may also be another shape. For example, the shape may be a trapezoid, a parallelogram, a rhombus, or the like.

The user may also designate the transformation amount for the embroidery pattern as hereinafter described, for example. Of the points 141 to 144 that are shown in FIG. 16, the user presses the ultrasound pen 91 against the work cloth 100 at only two points that are located at diagonally opposite corners of the rectangle 145, such as the point 141 and the point 143, for example. The CPU 61 may specify the positions of the points 141, 143 as the designated positions. The CPU 61 may define a rectangle in which the points 141, 143 are at opposite ends of a diagonal. The CPU 61 may transform the embroidery pattern such that the embroidery pattern fits exactly within the defined rectangle. The user may also designate any three of points 141 to 144 that are shown in FIG. 16. The CPU 61 may define a rectangle based on the positions of the three designated points.

Furthermore, the user may also designate the transformation amount for the embroidery pattern as hereinafter described, for example. With the ultrasound pen 91, the user describes two intersecting line segments on the work cloth 100. Using the same sort of method that is described in the modified examples of the first control processing and the second control processing, the CPU 61 may specify the length of each of the two intersecting line segments that have been described on the work cloth 100. The CPU 61 may define a quadrilateral in which the two line segments that have the specified lengths serve as the diagonals. The CPU 61 may transform the embroidery pattern in accordance with the defined quadrilateral.

Figure 17:
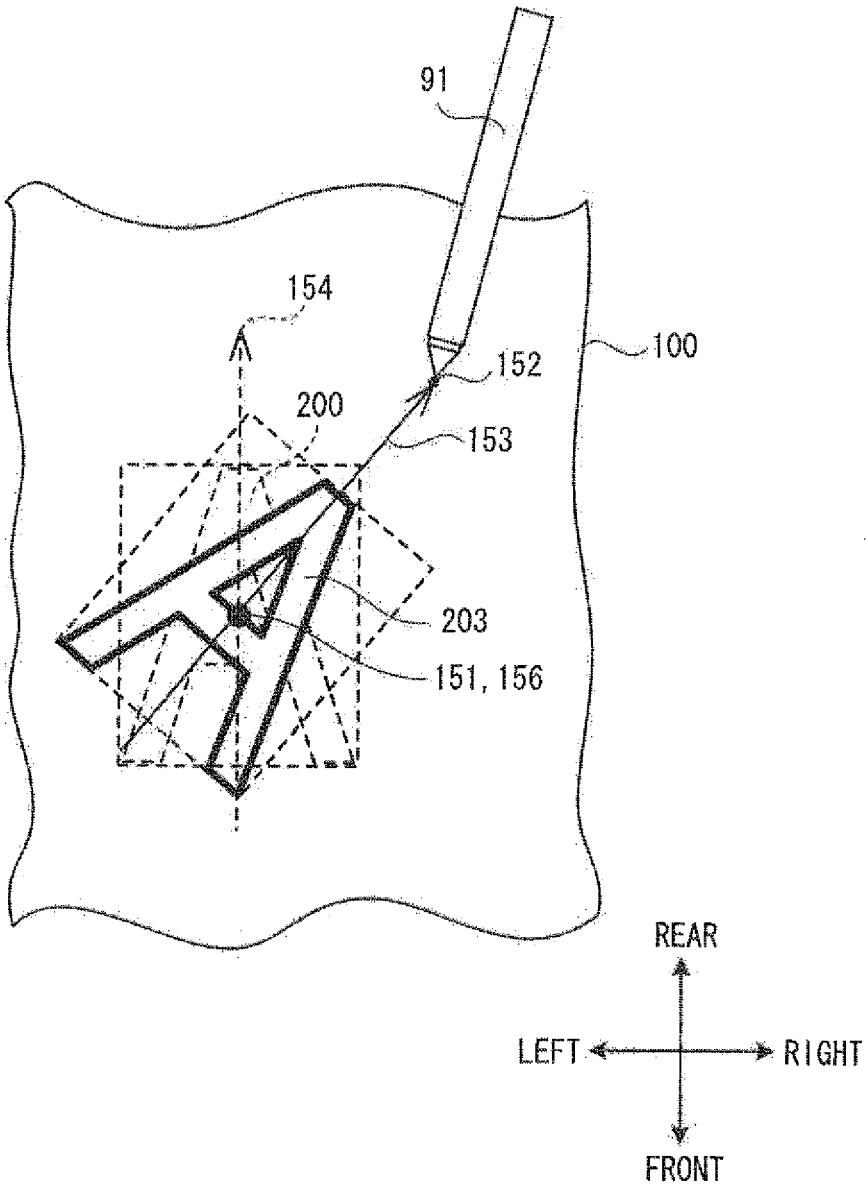
FIG. 17 is an explanatory figure of a method for using the ultrasound pen to designate a pattern angle.

The fourth control processing will be explained with reference to FIG. 13. Explanations will be omitted or simplified for processing that is the same as the third control processing (refer to FIG. 12). The CPU 61 displays on the LCD 15 a screen on which an embroidery pattern can be selected (Step S111). In a case where an embroidery pattern has been selected by a panel operation, the CPU 61 displays on the LCD 15 a screen that shows the selected embroidery pattern. In the present embodiment, an example will be used in which the character "A" 200 has been selected, in the same manner as in the explanation of the third control processing. As shown in FIG. 17, the pattern data for the character "A" 200 include reference line data. The reference line data are data that indicate a reference line 154 for the character "A" 200. The reference line 154 is a straight line that passes through a reference point 156 in the pattern data and extends parallel to the Y axis (which is equivalent to the front-rear direction). The CPU 61 displays a pattern angle designation screen on the LCD 15 (Step S113). The pattern angle designation screen is a screen that indicates that the sewing machine 1 is in a state in which the sewing machine 1 is able to rotate the selected embroidery pattern based on the ultrasonic waves that are transmitted from the ultrasound pen 91.

For example, the user can designate the pattern angle by pressing the pen tip 911 of the ultrasound pen 91 against the work cloth 100 at two points in sequence. In a case where the pen tip 911 of the ultrasound pen 91 has been pressed against the work cloth 100 at points 151, 152 in that order, as shown in FIG. 17, the CPU 61 specifies a virtual line segment 153. The virtual line segment 153 is a line segment on opposite ends of which the points 151, 152 are located. That is, the virtual line segment 153 is a line segment between the point 151 and the point 152. The angle that is formed between the reference line 154 and the virtual line segment 153 is equivalent to the pattern angle. The CPU 61 positions the character "A" 200 that is the embroidery pattern such that the reference point 156 is coincident with the point 151 and rotates the character "A" 200 such that the reference line 154 coincides with the virtual line segment 153. In concrete terms, for example, the CPU 61 specifies data that indicate the position of the point 151. Based on the pattern data that are stored in the ROM 62 in advance and on the data that indicate the position of the specified point 151, the CPU 61 specifies the pattern data for sewing the character "A" 200. The CPU 61 specifies the pattern angle based on the reference line data and the data that indicate the virtual line segment 153. Based on the specified pattern angle and on the pattern data for sewing the character "A" 200, the CPU 61 generates the pattern data for sewing a rotated character "A" 203. The character "A" 203 that is shown in FIG. 17 describes the rotated embroidery pattern, that is, the embroidery pattern that to actually be sewn on the work cloth 100.

Figure 13:
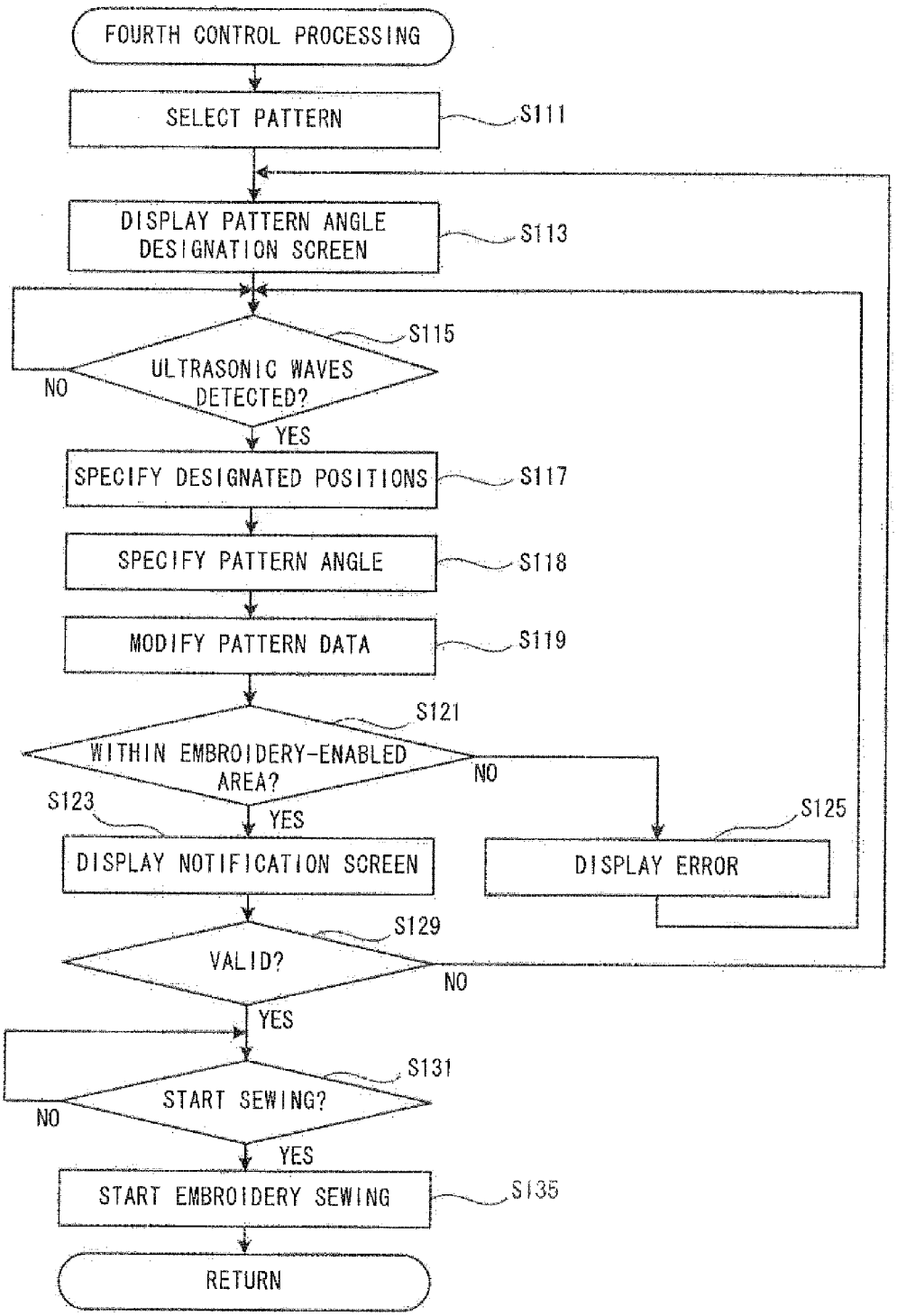
FIG. 13 is a flowchart that shows fourth control processing.

As shown in FIG. 13, the CPU 61 determines whether the ultrasonic waves have been detected through the receivers 94, 95 (Step S115). In a case where the ultrasonic waves have not been detected through the receivers 94, 95 (NO at Step S115), the CPU 61 returns the processing to Step S115.

In a case where the user has pressed the pen tip 911 of the ultrasound pen 91 against the work cloth 100 at two points in sequence in order to designate the pattern angle, the CPU 61 specifies the two corresponding transmission times T1 and the two corresponding pairs of the detection times T2. In a case where the ultrasonic waves from the two points have been detected through the receivers 94, 95 (YES at Step S115), the CPU 61 specifies the designated positions for the two points by computing the respective designated coordinates E based on the two corresponding transmission times T1 and the two corresponding pairs of the detection times T2 (Step S117). The CPU 61 specifies the line segment on which the designated position that was designated first and the designated position that was designated second are located at opposite ends. The CPU 61 specifies the angle of the specified line segment in relation to the reference line 154 as the pattern angle (Step S118).

The CPU 61 modifies the pattern data based on the designated positions and the pattern angle that were respectively specified at Steps S117, S118 (Step S119).

Based on the pattern data that were modified at Step S119, the CPU 61 determines whether the rotated embroidery pattern fits inside the embroidery-enabled area (Step S121). In a case where the rotated embroidery pattern does not fit inside the embroidery-enabled area (NO at Step S121), the CPU 61 displays on the LCD 15 an error message that indicates that the designation of the pattern angle by the ultrasound pen 91 is invalid (Step S125). The CPU 61 returns the processing to Step S115. In a case where the rotated embroidery pattern does fit inside the embroidery-enabled area (YES at Step S121), the CPU 61 displays a rotated pattern screen on the LCD 15 (Step S123). The rotated pattern screen is a screen that notifies the user by displaying the embroidery pattern that has been rotated based on the pattern angle and on which the user can input whether the embroidery pattern of which the user has been notified is valid or invalid. The user may determine whether the rotated embroidery pattern is valid and use a panel operation to input the result of the determination to the sewing machine 1. The CPU 61 determines whether a panel operation has been detected that indicates that the rotated embroidery pattern is valid (Step S129). In a case where a panel operation has been detected that indicates that the rotated embroidery pattern is invalid (NO at Step S129), in order to restart the processing for specifying the pattern angle from the beginning, the CPU 61 returns the processing to Step S113.

In a case where a panel operation has been detected that indicates that the rotated embroidery pattern is valid (YES at Step S129), the CPU 61 determines whether the operation of the start-and-stop switch (among the operation switches 21) has been detected that issues the command to start sewing (Step S131). In a case where the operation of the start-and-stop switch has not been detected (NO at Step S131), the CPU 61 returns the processing to Step S131. In a case where the operation of the start-and-stop switch has been detected (YES at Step S131), the CPU 61 starts processing that sews the rotated embroidery pattern on the work cloth 100 based on the pattern data that were modified at Step S119 (Step S135). The sewing machine 1 is thus able to sew the rotated embroidery pattern on the work cloth 100. At that point the fourth control processing is terminated, and the CPU 61 returns the processing to the main processing (refer to FIG. 9).

As described above, the user can use the pen tip 911 of the ultrasound pen 91 to designate positions on the work cloth 100. The sewing machine 1 is able to set the pattern angle based on the designated positions. The user can designate the pattern angle by using the ultrasound pen 91 to designate the positions on the work cloth 100. The sewing machine 1 is able to sew on the work cloth 100 the embroidery pattern that has been rotated based on the designated pattern angle.

The sewing machine 1 may also receive the designating of the pattern angle by another method. For example, the user may designate the pattern angle as will be described. The user may press the ultrasound pen 91 against the work cloth 100 such that the virtual line segment 153 is described, as shown in FIG. 17. By the same sort of method as in the modified examples of the first control processing and the second control processing, the CPU 61 may specify the pattern angle by specifying the point 151, which is the starting point of the virtual line segment 153 that is described on the work cloth 100, and the point 152, which is the ending point.

Note that the present disclosure is not limited to the embodiment that has been described above, and various types of modifications can be made. The user may also use the ultrasound pen 91 to designate, as the sewing information for the sewing machine 1, information that pertains to the sewing other than the swing width, the feed amount, the base line position, the transformation amount, and the pattern angle.

In the embodiment that is described above, the CPU 61 specifies the designated position based on the transmission time T1 and the pair of the detection times T2 for the ultrasonic waves. The designated position may also be specified by another method. For example, the CPU 61 may specify the designated position based only on the transmission time T1 for the ultrasonic waves. Note that the sewing machine 1 may also be provided with more than two of the receivers, although a detailed explanation of this will be omitted. The sewing machine 1 may specify the designated position by specifying a set of the detection times T2 based on the ultrasonic waves that are detected by each of receivers.

In the embodiment that is described above, the third control processing and the fourth control processing are performed in a state in which the embroidery device 2 has been mounted on the sewing machine 1. The third control processing and the fourth control processing may also be performed in a state in which the embroidery device 2 has not been mounted on the sewing machine 1, and among the ordinary patterns, the size, the shape, and the pattern angle of a decorative pattern may be modified.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine, comprising:

a sewing portion comprising i) a needle bar, ii) a transport portion and iii) a swinging portion, the needle bar being configured to have a sewing needle on a lower end, the transport portion being configured to move a work cloth, and the swinging portion being configured to swing the needle bar in a swinging direction;

a detector configured to detect ultrasonic waves;

a processor; and a memory storing computer-readable instructions that instruct the processor to perform:

specifying a position of a transmission source of the ultrasonic waves, based on the ultrasonic waves that are detected by the detector;

specifying sewing information based on the specified position of the transmission source, the sewing information being information that pertains to sewing, the specifying the sewing information comprising specifying a swing width based on the position of the transmission source, the swing width being included in the sewing information and being a distance that the swinging portion swings the needle bar in the swinging direction; and controlling the sewing portion based on the specified sewing information, the controlling the sewing portion comprising causing the swinging portion to swing the needle bar by the specified swing width.

2. The sewing machine according to claim 1, wherein the specifying the position of the transmission source comprises specifying two positions of the transmission source, and wherein the specifying the sewing information comprises specifying the swing width based on a distance between the two specified positions of the transmission source.

3. A sewing machine, comprising:

a sewing portion comprising i) a needle bar, ii) a transport portion and iii) a swinging portion, the needle bar being configured to have a sewing needle on a lower end, the transport portion being configured to move a work cloth, and the swinging portion being configured to swing the needle bar in a swinging direction, a detector configured to detect ultrasonic waves;

a processor; and a memory storing computer-readable instructions that instruct the processor to perform:

specifying a position of a transmission source of the ultrasonic waves, based on the ultrasonic waves that are detected by the detector;

specifying sewing information based on the specified position of the transmission source, the sewing information being information that pertains to sewing, the specifying the sewing information comprising specifying a base line position based on the position of the transmission source, the base line position being included in the sewing information and being a position of a base line that indicates a needle drop position in the swinging direction, and the needle drop position being a position where the sewing needle that is attached to the needle bar pierces the work cloth; and controlling the sewing portion based on the specified sewing information, the controlling the sewing portion comprising causing the swinging portion to position the needle bar above the specified base line position.

4. The sewing machine according to claim 3, wherein the specifying the position of the transmission source comprises specifying one position of the transmission source, and wherein the specifying the sewing information comprises specifying, as the base line position, a position of a line that passes through the one specified position of the transmission source and that extends in the direction in which the transport portion moves the work cloth.

5. A sewing machine, comprising:

a sewing portion comprising a needle bar and a transport portion, the needle bar being configured to have a sewing needle on a lower end, and the transport portion being configured to move a work cloth;

a detector configured to detect ultrasonic waves;

a processor; and a memory storing computer-readable instructions that instruct the processor to perform:

specifying a position of a transmission source of the ultrasonic waves, based on the ultrasonic waves that are detected by the detector;

specifying sewing information based on the specified position of the transmission source, the sewing information being information that pertains to sewing, the specifying the sewing information comprising specifying a pattern angle based on the position of the transmission source, the pattern angle being included in the sewing information and being an angle by which a pattern is rotated; and controlling the sewing portion based on the specified sewing information, the controlling the sewing portion comprising causing the sewing portion to perform a sewing operation, the sewing operation being an operation for sewing on the work cloth the pattern that has been rotated based on the specified pattern angle.

6. The sewing machine according to claim 5, wherein the specifying the position of the transmission source comprises specifying two positions of the transmission source, and wherein the specifying the sewing information comprises specifying the pattern angle based on a direction in which a virtual line segment extends, the virtual line segment being a line segment between the two specified positions of the transmission source.

7. The sewing machine according to claim 6, wherein the memory further stores pattern data, the pattern data being data for sewing the pattern, the pattern data including reference line data, the reference line data being data that indicate a reference line that is a line that is related to the positioning of the pattern, and wherein the specifying the sewing information comprises specifying the pattern angle based on an angle that is formed between the virtual line segment and the reference line.

8. A sewing machine, comprising:

a sewing portion comprising a needle bar and a transport portion, the needle bar being configured to have a sewing needle on a lower end, and the transport portion being configured to move a work cloth;

a detector configured to detect ultrasonic waves;

a processor; and a memory storing computer-readable instructions that instruct the processor to perform:

specifying a position of a transmission source of the ultrasonic waves, based on the ultrasonic waves that are detected by the detector;

specifying sewing information based on the specified position of the transmission source, the sewing information being information that pertains to sewing, the specifying the sewing information comprising specifying one of a transformation amount and a transformation rate based on the position of the transmission source, at least one of the transformation amount and the transformation rate being included in the sewing information and being information for transforming a pattern;

transforming the pattern based on the specified one of the transformation amount and the transformation rate, and controlling the sewing portion based on the specified sewing information, the controlling the sewing portion comprising causing the sewing portion to perform a sewing operation, the sewing operation being an operation for sewing the transformed pattern on the work cloth.

9. The sewing machine according to claim 8, wherein the memory further stores pattern data, the pattern data being data for sewing the pattern, the pattern data including size data, the size data being data that indicate the size of the pattern, the specifying the position of the transmission source comprises specifying at least two positions of the transmission source, and the specifying the sewing information comprises specifying the one of the transformation amount and the transformation rate based on the size data and on the at least two specified positions of the transmission source.

* * * * *